US010753133B2

(12) United States Patent
Kohlweiss

(10) Patent No.: US 10,753,133 B2
(45) Date of Patent: Aug. 25, 2020

(54) EJECTION DEVICE FOR A FOLDING DOOR OR FOLDING SLIDING DOOR

(71) Applicant: Julius Blum GmbH, Hoechst (AT)

(72) Inventor: Franz Kohlweiss, Hard (AT)

(73) Assignee: Julius Blum GmbH, Hoechst (AT)

( * ) Notice: Subject to any disclaimer, the term of this patent is extended or adjusted under 35 U.S.C. 154(b) by 393 days.

(21) Appl. No.: 15/856,624

(22) Filed: Dec. 28, 2017

(65) Prior Publication Data

US 2018/0119470 A1 May 3, 2018

Related U.S. Application Data

(63) Continuation of application No. PCT/AT2016/050191, filed on Jun. 10, 2016.

(30) Foreign Application Priority Data

Jun. 29, 2015 (AT) ..... A 411/2015

(51) Int. Cl.
*E05D 15/26* (2006.01)
*E05D 15/58* (2006.01)
*E05F 1/10* (2006.01)

(52) U.S. Cl.
CPC ..... *E05D 15/264* (2013.01); *E05D 15/58* (2013.01); *E05F 1/1041* (2013.01); *E05Y 2900/212* (2013.01)

(58) Field of Classification Search
CPC ..... E06B 3/367; E06B 3/385; E06B 3/4663; E06B 3/482; E06B 3/5045;
(Continued)

(56) References Cited

U.S. PATENT DOCUMENTS 2,573,181 A * 10/1951 Burr ..... E05D 15/262 160/191
3,275,064 A * 9/1966 Hansen ..... E05D 3/022 160/206

(Continued)

FOREIGN PATENT DOCUMENTS

AT 516586 6/2016
CN 104080992 10/2014

(Continued)

OTHER PUBLICATIONS

International Search Report dated Sep. 13, 2016 in International (PCT) Application No. PCT/AT2016/050191.

(Continued)

*Primary Examiner* — Johnnie A. Shablack
(74) *Attorney, Agent, or Firm* — Wenderoth, Lind & Ponack, L.L.P.

(57) ABSTRACT

An ejection device includes an ejection element for spreading apart a folding door from a closed position. At least two door wings are arranged in a common closing plane, towards an open position, and the at least two door wings form an angle different from 180° relative to each other. The ejection element can be acted upon by an energy storage member to be manually loaded by an operator, and the ejection device includes a locking device for releasably locking the ejection element against the force of the loaded energy storage member. The locking device can be unlocked by applying pressure to the folding door. The ejection device includes a movably-mounted loading element for loading the energy storage member by folding together the folding door. The ejection element and the loading element are spatially separated constructional units, and the ejection element is a pivotally mounted ejection lever.

16 Claims, 23 Drawing Sheets

(58) Field of Classification Search
CPC ..... E05Y 2900/20; E05Y 2900/202; E05D 15/26; E05D 15/264; E05D 15/581; E05D 15/58; E05D 2015/268; E05D 2015/485; E05D 2015/487; E05F 1/1041; E05F 1/12; E05F 1/1207; E05F 1/1246; E05F 1/14; E05F 1/16; E05F 1/10; E05F 1/105
See application file for complete search history.

(56) References Cited

U.S. PATENT DOCUMENTS

| | | | | |
|---|---|---|---|---|
| 3,628,217 | A * | 12/1971 | Schaber | E05D 11/1064 16/292 |
| 3,795,217 | A * | 3/1974 | Kloess | B63B 19/197 114/202 |
| 3,936,978 | A * | 2/1976 | Barras | E04D 13/0357 49/252 |
| 4,191,412 | A | 3/1980 | LeKander | |
| 4,545,418 | A | 10/1985 | List et al. | |
| 6,262,548 | B1 * | 7/2001 | Scholten | E05F 15/614 16/62 |
| 6,539,581 | B1 * | 4/2003 | Faringosi | E05F 1/1261 126/194 |
| 7,185,398 | B2 * | 3/2007 | Kral | E05F 1/1066 16/72 |
| 7,240,974 | B2 * | 7/2007 | Hirtsiefer | E05D 15/262 312/109 |
| 8,096,341 | B2 * | 1/2012 | Teunissen | E05D 15/26 160/199 |
| 8,905,498 | B2 * | 12/2014 | Hammerle | A47B 88/40 312/333 |
| 9,068,386 | B2 | 6/2015 | Ishii et al. | |
| 9,085,926 | B2 * | 7/2015 | Collinson | E05F 15/63 |
| 9,255,430 | B2 * | 2/2016 | Lucas | E06B 9/0676 |
| 9,303,443 | B2 * | 4/2016 | Lucas | E05D 15/262 |
| 9,428,950 | B2 | 8/2016 | Braungart | |
| 9,498,062 | B2 * | 11/2016 | Baldereich | E05D 11/1064 |
| 10,113,346 | B2 * | 10/2018 | Kohlweiss | E05D 3/02 |
| 10,240,375 | B2 * | 3/2019 | Brunnmayr | E05F 1/1246 |
| 10,316,565 | B2 * | 6/2019 | Gabl | E05F 1/1041 |
| 10,400,493 | B2 * | 9/2019 | Gabl | E06B 5/006 |
| 10,508,483 | B2 * | 12/2019 | Dubach | E05F 1/1041 |
| 2013/0239363 | A1 * | 9/2013 | apur | E05F 5/006 16/50 |
| 2013/0292067 | A1 * | 11/2013 | Lucas | E06B 9/0638 160/213 |
| 2015/0008811 | A1 | 1/2015 | Ishii et al. | |
| 2015/0084492 | A1 | 3/2015 | Braungart | |
| 2017/0030071 | A1 * | 2/2017 | Sorensen | E04B 1/3444 |
| 2017/0247924 | A1 * | 8/2017 | Gabl | E05F 1/1041 |
| 2018/0100338 | A1 * | 4/2018 | Dubach | E05F 1/16 |
| 2018/0119470 | A1 * | 5/2018 | Kohlweiss | E05D 15/58 |
| 2018/0155972 | A1 * | 6/2018 | Filges | E05C 19/165 |
| 2018/0258686 | A1 * | 9/2018 | Christenson | E06B 5/00 |
| 2019/0048981 | A1 * | 2/2019 | Flogaus | F16H 21/44 |
| 2019/0071911 | A1 * | 3/2019 | Brunnmayr | E05F 1/1058 |
| 2019/0284859 | A1 * | 9/2019 | Rupp | E05D 15/58 |
| 2019/0301216 | A1 * | 10/2019 | Rupp | E05F 5/003 |
| 2019/0301218 | A1 * | 10/2019 | Rupp | E06B 3/5045 |
| 2019/0330896 | A1 * | 10/2019 | Rupp | E06B 3/482 |
| 2019/0330897 | A1 * | 10/2019 | Rupp | E05D 15/58 |
| 2020/0018106 | A1 * | 1/2020 | Rupp | E05D 15/0634 |
| 2020/0018107 | A1 * | 1/2020 | Rupp | E05D 15/264 |
| 2020/0018108 | A1 * | 1/2020 | Sperger | E05D 15/58 |
| 2020/0040632 | A1 * | 2/2020 | Rupp | A47B 61/00 |
| 2020/0063482 | A1 * | 2/2020 | Kohlweiss | E06B 3/482 |
| 2020/0071980 | A1 * | 3/2020 | Blum | E06B 3/5054 |
| 2020/0072532 | A1 * | 3/2020 | Moller | E05F 1/14 |

FOREIGN PATENT DOCUMENTS

| | | | | |
|---|---|---|---|---|
| CN | 104364456 | | 2/2015 | |
| CN | 104612552 | | 5/2015 | |
| DE | 20 2006 000 535 | | 4/2006 | |
| DE | 202018100241 | U1 * | 1/2018 | E05F 1/10 |
| GB | 1 257 999 | | 12/1971 | |
| JP | 04-131485 | | 5/1992 | |
| JP | 2705557 | | 1/1998 | |
| JP | 2011-162994 | | 8/2011 | |
| JP | 2012-1916 | | 1/2012 | |
| JP | 2012001916 | A * | 1/2012 | E05D 15/264 |
| JP | 2014-029103 | | 2/2014 | |
| WO | 2007/074397 | | 7/2007 | |
| WO | 2012/155165 | | 11/2012 | |
| WO | 2013/114730 | | 8/2013 | |
| WO | 2013/134797 | | 9/2013 | |
| WO | 2013/173853 | | 11/2013 | |

OTHER PUBLICATIONS

Search Report dated Apr. 8, 2016 in Austrian Application No. A 411/2015, with English translation.

* cited by examiner

EJECTION DEVICE FOR A FOLDING DOOR OR FOLDING SLIDING DOOR

BACKGROUND OF THE INVENTION

1. Field of the Invention

The invention relates to an ejection device for a folding door or a folding-sliding door having at least two door wings hingedly connected to one another, wherein the ejection device includes at least one ejection element for spreading apart the folding door or the folding-sliding door from a closed position, in which the at least two door wings are arranged in a common closing plane, towards an open position, in which the at least two door wings form an angle different from 180° relative to each other, wherein the at least one ejection element can be acted upon by an energy storage member to be manually loaded by an operator and the at least one ejection device includes at least one locking device for releasably locking the at least one ejection element against the force of the at least one loaded energy storage member, wherein the at least one locking device, when the ejection device is mounted, can be unlocked by applying pressure to the folding door or the folding-sliding door, preferably in the region where the at least two door wings are hingedly connected to one another, wherein the ejection device includes at least one movably-mounted loading element for loading the at least one energy storage member by folding together the folding door or folding-sliding door. The invention further concerns an item of furniture having a furniture carcass, at least one folding door or folding-sliding door having at least two door wings hingedly connected to one another, wherein the folding door or folding-sliding door can assume a closed position in which the at least two door wings are arranged in a common closing plane, and an open position in which the at least two door wings form an angle different from 180° relative to each other, and at least one ejection device according to the invention.

2. Description of the Related Art

An ejection device of the described type is known from the Austrian application A 855/2014 to the applicant. The drawback of this ejection device is the fact that it is mounted to the furniture carcass and that the accessibility to the interior of the item of furniture is thereby impeded when the folding door or folding-sliding door is in an opened condition. Moreover, the ejection device affects the overall aesthetic impression. Finally, the force relations for loading the energy storage member have proven to be unfavorable.

A further ejection device is disclosed in document JP 2011-16 29 94 A. Disclosed therein is a device for spreading apart a folding door having two door wings hingedly connected to one another, starting from a closed position towards an open position. For spreading apart the door wings, an ejection element is provided which can be acted upon by an energy storage member to be loaded by an operator. The ejection device further includes a locking device for releasably locking the ejection element against the force of the loaded energy storage member, wherein the locking device, when the ejection device is mounted, can be unlocked by applying pressure to the folding door. The ejection element thereby also constitutes a movably-supported loading element for loading the energy storage member.

SUMMARY OF THE INVENTION

The object of the present invention is therefore to propose an improved ejection device with respect to the prior art and to propose an item of furniture with such an ejection device, wherein the ejection device, in particular, resolves the drawbacks discussed above.

It is thus provided that the at least one ejection element and the at least one loading element are configured as spatially separated constructional units, wherein the at least one ejection element is configured as a pivotally mounted ejection lever. In this way, the lever action of the door can be advantageously utilized for loading the at least one energy storage member. Moreover, it is possible to arrange the ejection device on one of the two door wings, so that the ejection device, when opening the folding door or folding-sliding door, disappears between the door wings when folded together and can therefore neither affect the accessibility to the interior space to the item of furniture nor the aesthetic impression.

In particular, it is provided that the ejection device is configured so as to be mirror-symmetrically. In this way, the ejection device is universally applicable both to a folding door or a folding-sliding door to be opened to the right as well as to be opened to the left.

Further details and advantages of the present invention will be further explained in the following on the basis of the description of figures with reference to the drawings, in which:

DETAILED DESCRIPTION OF THE INVENTION

Figure 1A:
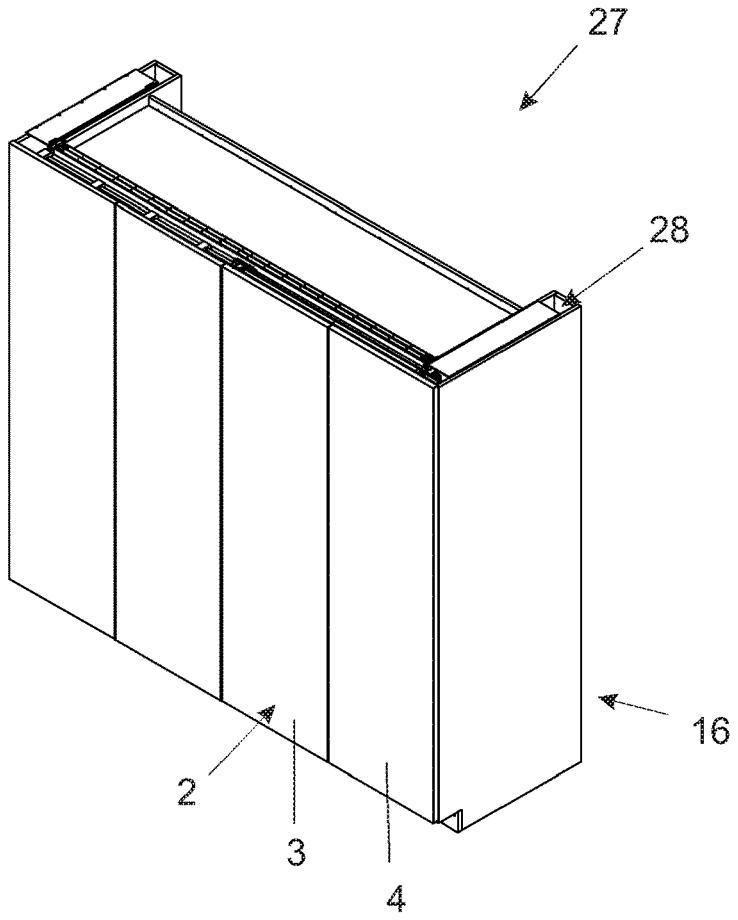
FIG. 1*a*) shows an item of furniture with a closed folding-sliding door in a perspective view, FIG. 1*b*) shows the item of furniture of FIG. 1*a*) in a top view, FIG. 1*c*) shows the position of the ejection device with the item of furniture according to FIG. 1*a*) and FIG. 1*b*) in a side view, FIG. 1*d*) shows the ejection device of FIG. 1*c*) in a perspective view, FIG. 1*e*) shows the ejection device in an exploded view, FIG. 2*a*) shows a top view of the item of furniture with the folding-sliding door in an overpressing position, FIG. 2*b*) shows the position of the ejection device with the item of furniture according to FIG. 2*a*) in a side view, FIG. 2*c*) shows a cross-section of the ejection device of FIG. 2*b*) in a perspective view, FIG. 2*d*) shows the locking device in the locked condition, FIG. 2*e*) shows the locking device in the unlocked condition, FIG. 2*f*) shows a cross-section of the locking device according to FIG. 2*e*), FIG. 2*g*) shows the locking device in an exploded view, FIG. 2*h*) shows the rear side of the component 44 of the locking device, FIG. 3*a*) shows a detail view of the item of furniture in a top view at the beginning of the spreading-apart process of the folding-sliding door, FIG. 3*b*) shows a side view of the ejection device in a condition when the folding-sliding door assumes the position according to FIG. 3*a*), FIG. 3*c*) shows the ejection device according to FIG. 3*b*) in a perspective view, FIG. 4*a*) shows an overall perspective view of the item of furniture with a further spread-apart folding-sliding door in relation to the position according to FIG. 3*a*), FIG. 4*b*) shows a top view of the item of furniture according to FIG. 4*a*), FIG. 5*a*) shows a detail view of the item of furniture in a top view with the ejection element fully extended, FIG. 5*b*) shows a perspective view of the ejection device in a condition when the folding-sliding door assumes the position according to FIG. 6*a*), FIG. 6*a*) shows a top view of the item of furniture at the beginning of folding together the folding-sliding door initiated by an operator, FIG. 6*b*) shows a side view of the ejection device in a condition when the folding-sliding door assumes the position according to FIG. 6*a*), FIG. 6*c*) shows the ejection device according to FIG. 6*b*) in a perspective view, FIG. 7) shows a perspective view of the ejection device in a condition when the folding-sliding door is further folded together, FIG. 8*a*) shows a top view of the item of furniture when the folding-sliding door is further folded together, FIG. 8*b*) shows a perspective view of the ejection device in a condition when the folding-sliding door assumes a position according to FIG. 8*a*), FIG. 8*c*) shows the ejection device according to FIG. 8*b*) with the ejection element 5 cut open, FIG. 9*a*) shows a top view of the item of furniture with the folding-sliding door further folded together, FIG. 9*b*) shows a perspective view of the ejection device in a condition when the folding-sliding door assumes a position according to FIG. 9*a*) and with the ejection element 5 cut open, FIG. 9*c*) shows a further cross-section of the ejection device in the condition according FIG. 9*b*), FIG. 10*a*) shows a top view of the item of furniture with the folding-sliding door fully folded together, FIG. 10*b*) shows the ejection device in a condition when the folding-sliding door assumes a position according to FIG. 10*a*), FIG. 10*c*) shows the ejection device according to FIG. 10*b*) with the ejection element 5 cut open, FIG. 11*a*) shows a perspective overall view of the item of furniture with the folding-sliding door partly countersunk in a lateral cavity, FIG. 11*b*) shows a top view of the item of furniture according to FIG. 11*a*), FIG. 12*a*) shows a perspective overall view of the item of furniture with the folding-sliding door fully countersunk into the cavity, FIG. 12*b*) shows a top view of the item of furniture according to FIG. 12*a*), FIG. 13*a*) shows a top view of the item of furniture with the folding-sliding door again withdrawn from the cavity and partly folded apart, FIG. 13*b*) shows the ejection device in a condition when the folding-sliding door assumes the position according to FIG. 13*a*) and with the ejection element 5 cut open, FIG. 13*c*) shows a detail of a cross-section of the ejection device in the condition according to FIG. 13*b*), and FIG. 14) shows a detail of a top view of the item of furniture with the folding-sliding door further folded apart in comparison with FIG. 13*a*).

FIG. 1*a*) shows an item of furniture 27 having a furniture carcass 16 and a folding-sliding door 2 including two door wings 3 and 4 hingedly connected to one another. The folding-sliding door 2 is located in a closed position in which the two door wings 3 and 4 are arranged in a common closing plane. In the furniture carcass 16, a cavity 28 is provided for accommodating the folding-sliding door 2 in a folded-together position. The cavity 28 is compartment-shaped and arranged in an edge region of the furniture carcass 16.

Figure 1B:
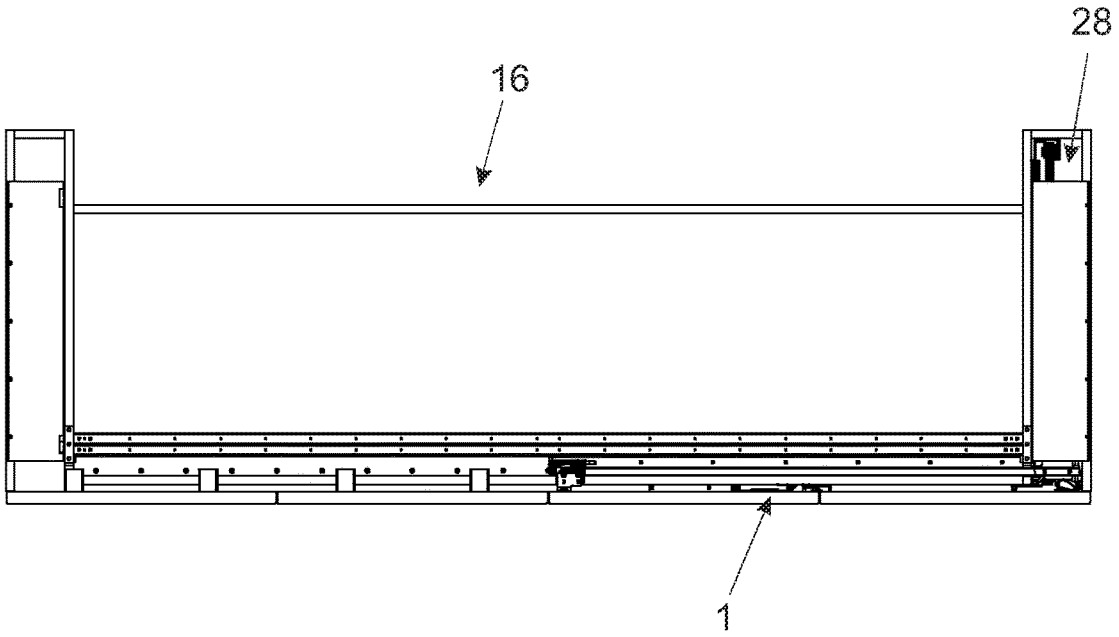

FIG. 1*b*) shows the item of furniture according to FIG. 1*a*) in a top view from above. Arranged on the folding-sliding door is an ejection device 1 which will be described in more detail in the following FIGS. 1*c*) through 1*e*):

The ejection device 1 is arranged on a side of the door wing 3 facing towards the furniture carcass 16 or towards the interior of the item of furniture, respectively. The rear edge of this door wing 3 is indicted with a dotted line 30. The ejection device 1 includes an ejection element 5 for spreading apart the folding-sliding door from a closed position towards an open position in which the two door wings form an angle different from 180° relative to each other.

The ejection element 5 has a support element 14 for supporting against a front face 17 of the furniture carcass 16, more precisely to a ceiling cover of the furniture carcass, when the folding-sliding door is spread apart, wherein the support element 14 is configured as a rolling body in the form of a roller.

The distance between the rear edge 30 of the door wing 3 and the ceiling cover 17 is provided with the reference number 31 and is approximately 15 mm. The ejection device 1 further includes more components, for example 24, 25 and 13 which protrude at most approximately 45 mm into the storage or working area, respectively, of the item of furniture. This distance is provided with the reference number 32.

Figure 1C:
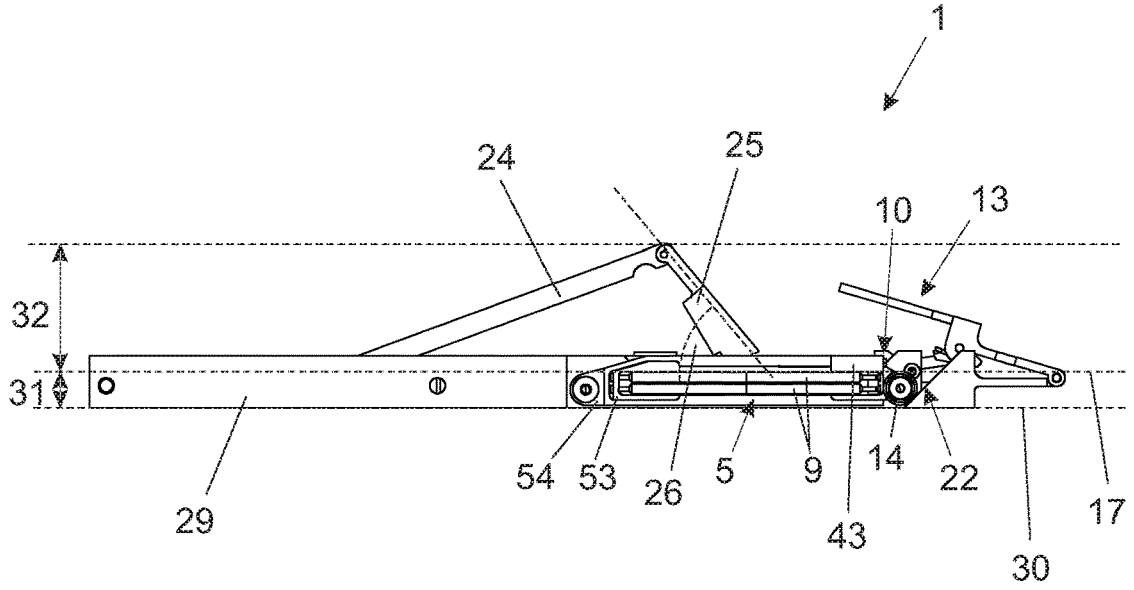
Figure 1D:
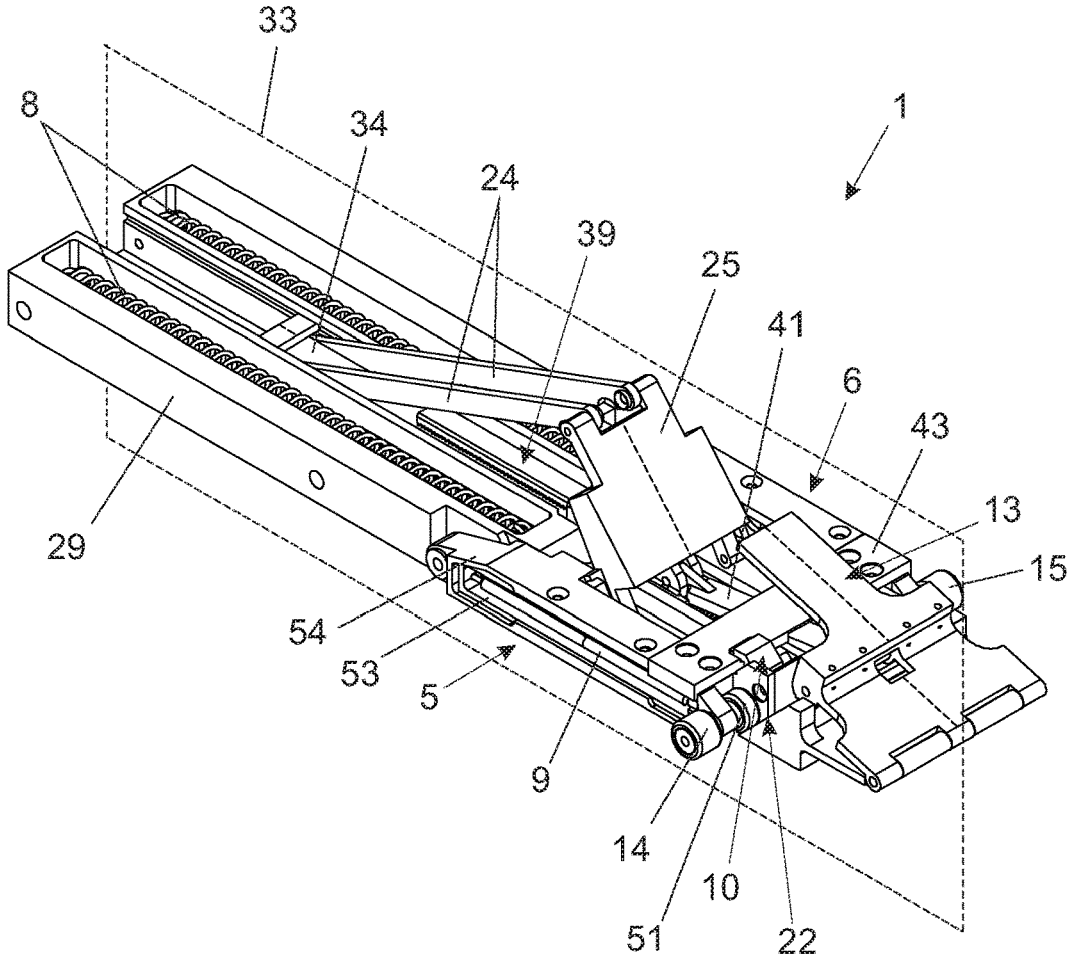

In FIG. 1*d*), a plane 33 of symmetry is depicted extending through the central longitudinal axis of the ejection device 1 and to which the ejection device 1 is configured so as to be mirror-symmetrical. The mirror-symmetrical configuration has the advantage that the ejection device 1 can be applied both to a folding-sliding door 2 as shown in FIG. 1*a*) as well as to a folding-sliding door which is arranged on the left thereof and which is to be opened to the left. For this purpose, the ejection device 1 needs solely to be turned by 180°. For the functionality of the ejection device 1, only one of the mirror-symmetrical halves would be sufficient.

In detail, the ejection device 1 is constructed as follows: The ejection device 1 includes a base 29 by which the ejection device 1 is to be mounted to a folding door or a folding-sliding door. In the present case, the ejection device 1 is mounted to the door wing 3 of the folding-sliding door 2 via the base 29. Arranged on the base 29 are two ejection elements 5 and 6 configured as pivotally mounted ejection levers. The ejection elements 5 and 6 each include a base 54 on which a first slider 53 is displaceably arranged. With respect to the base 54, the slider 53 is acted upon by a force of a first energy storage member 9 in the form of two tension springs arranged in parallel relationship. On the free end of the displaceable slider 53, two rolling bodies in the form of rollers are arranged, namely on the one hand the support element 14 for supporting against the furniture carcass on the other hand a roller 51 configured to be supported on an inclined surface 22 for initiating the spreading-apart movement of ejection element 5. In the case of the identically-configured ejection element 6, both rollers are provided with the reference numbers 15 and 52 and the inclined surface, against which the roller 52 can be supported at the beginning of the spreading-apart movement, is provided with the reference number 23.

On the base 54 of the ejection elements 5 and 6, respectively, a further slider 56 is displaceably arranged laterally besides the slider 53, the further slider 56 can also be acted upon by a force of an energy storage member in the form of a tension spring 57 relative to the base 54. The slider 56, together with the compression spring 58 acting on a locking device 40 and a bolt 55, serve for releasably fixing the engagement angle 26 (see FIG. 1*c*)) of a force deflection lever 24, 25 to the ejection elements 5 and 6. The functionality of this locking device will be explained in more detail in connection with FIGS. 8*c*), 9*b*), 10*c*) and 13*b*).

The sliders 53 of the ejection elements 5 and 6 are motionally coupled to one another via a connecting element 43.

Besides the energy storage member 9, there is a further independent energy storage member 8 in the form of two tension springs for pressurizing the ejection elements 5 and 6, wherein the force-pressurizing is effected by a force deflection lever which is pivotally mounted to the slider 56 and which is constructed of a first plate-shaped component 25 and two arms 24 hingedly connected thereto. The arms 24, with their other ends, are pivotally mounted to a linearly displaceable slider 34 which is linearly displaceable on the base 29. The tension springs 8 are suspended via mountings 35 to the linear slider 34 on the one hand and to the base 29 on the other hand.

When the engagement angle 26 of the force deflection lever 24, 25 is fixed to the ejection elements 5 and 6, the force deflection lever 24, 25, seen in a side view (see FIG. 1*c*)), protrudes from the ejection device 1 in a knee-shaped manner.

The ejection device 1 further includes two locking devices 10 and 11 for releasably locking the ejection elements 5 and 6 against the force of the loaded energy storage members 8 and 9. The construction and functionality of the locking devices 10 and 11 will be explained in more detail in connection with FIGS. 2*c*) through 2*h*).

Further provided is a loading element 13 movably mounted on the base 29 of the ejection device 1, wherein this loading element 13 is configured as a pivotally mounted loading lever. The loading element 13 is held relative to the base 29 by an energy storage member in the form of two leg springs 42 in the position as shown in FIGS. 1*c*) and 1*d*).

The ejection elements 5 and 6 and the loading element 13 are motionally coupled to one another by a synchronization device 18. The synchronization device 18 includes a tooth arrangement in the form of a gear 20 rotatably mounted to the base 29 via a housing 37, and the gear 20 meshes on the one hand with a tooth arrangement 19 arranged on a linear slider 38 and with a toothed rack 21 arranged on a linear slider 39 on the other hand. The linear slider 39 is coupled to the loading element 13 via a connecting element 41. The linear slider 38 is adapted to be coupled to the linear slider 34 by a locking pawl 36. For this purpose, the locking pawl 36 latches with a peg into an opening 67 of the linear slider 38. Details to this coupling of the sliders 34 and 38 will be explained in more detail in connection with FIGS. 9*c*) and 13*c*).

In the condition shown in FIGS. 1*c*) and 1*d*) which assumes the ejection device 1 when the folding-sliding door 2 is in the closed position, the energy storage members 8 and 9 are fully loaded and the ejection elements 5 and 6 are locked via the locking devices 10 and 11 against the force of the loaded energy storage members 8 and 9. Moreover, the engagement angle of the force deflection lever 24, 25 on the ejection elements 5 and 6 is fixed.

Figure 2A:
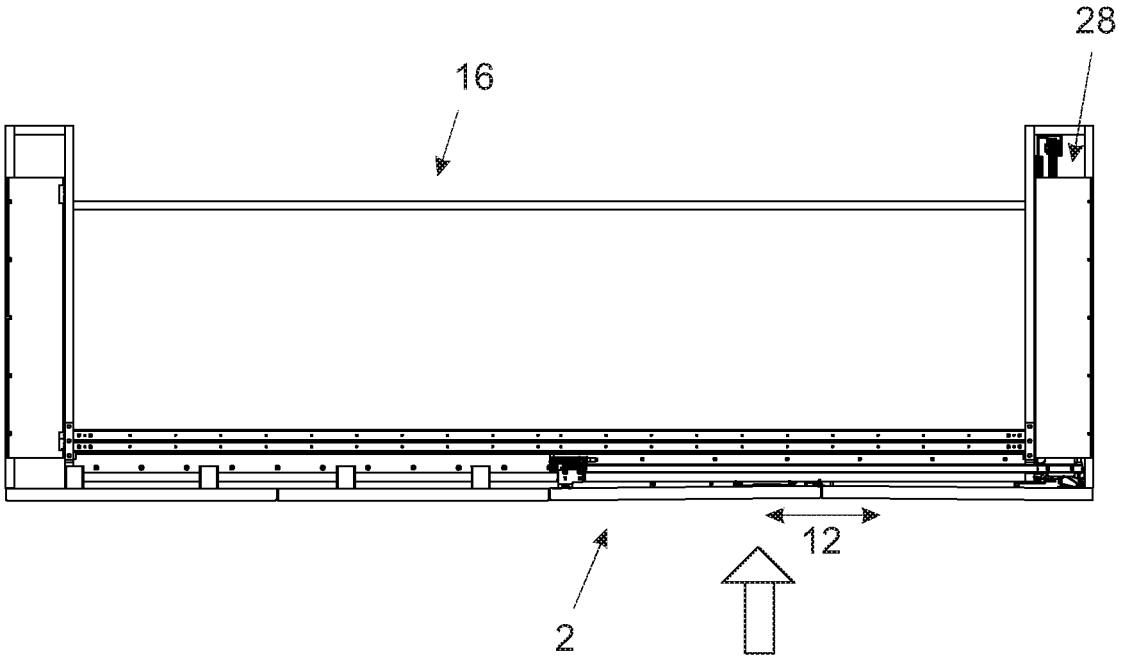
Figure 2B:
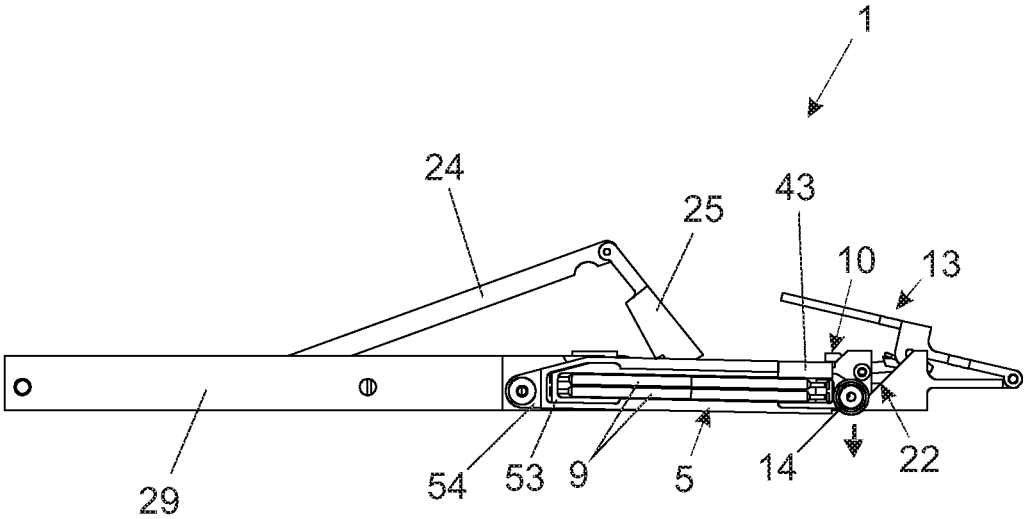

For unlocking the locking devices 10 and 11, an operator applies pressure to the folding-sliding door 2 (see FIG. 2*a*). In this way, the folding-sliding door 2 is being brought into an overpressing position. The application of pressure is effected advantageously in that region 12 in which the two door wings 3 and 4 are hingedly connected to one another. In the shown embodiment, the trigger path is 2 mm.

Because of the fact that the ejection device 1 is mounted to the folding-sliding door 2 and, at the same time, is supported against the front face 17 of the furniture carcass 16 via the supporting element 14, the ejection element 5, by the application of pressure to the folding-sliding door 2, and indirectly as a consequence, because the connecting element 43, in the locked state, engages between the two ejection elements 5 and 6 into grooves 59 of a latching wedge 44 of the locking device 10 and 11, the latching wedge 44 is being pushed downwardly, i.e. in a direction of the door wings 3 and 4 of the folding-sliding door 2.

Figure 2C:
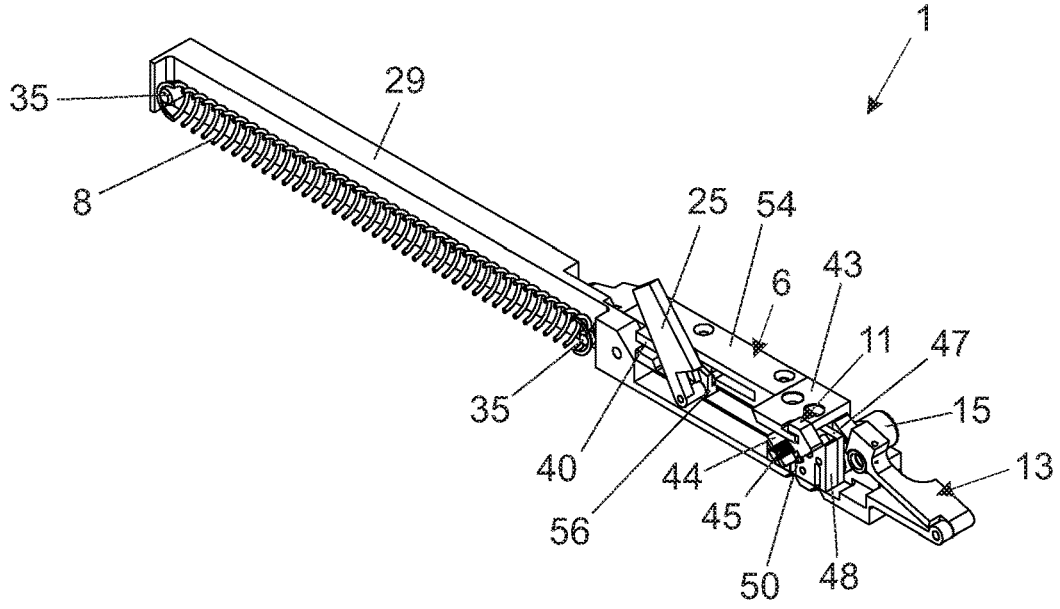
Figure 2D:
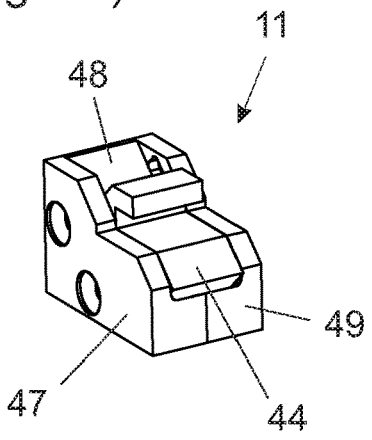
Figure 2E:
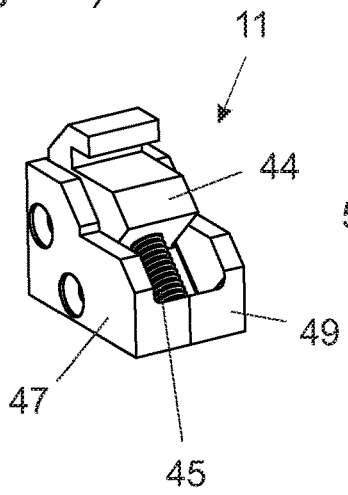
Figure 2F:
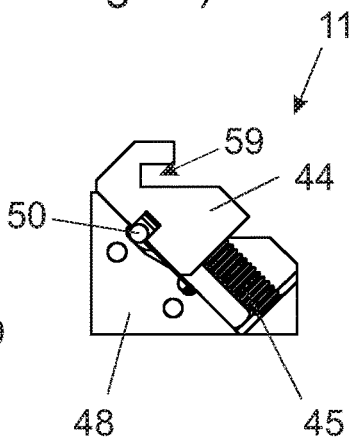
Figure 2G:
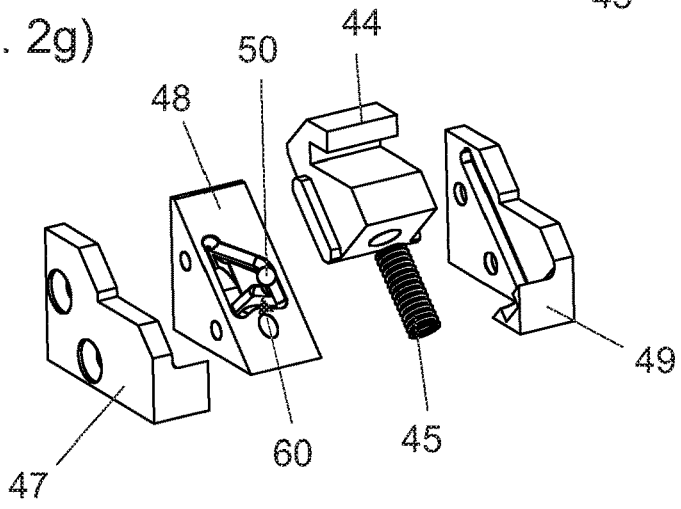
Figure 2H:
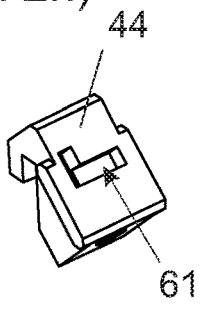

As can be seen from FIGS. 2*c*) through 2*h*), the latching wedge 44 interacts via a ball 50 arranged in a guide groove 61 with a heart-curved shaped locking track 60 formed in a base element 48, and the latching wedge 44, in the locked position in which the ball 50 is located within the trough of the heart, is acted upon by a force of a compression spring 45 relative to the base element 48. By the unlocking movement of the latching wedge 44, the ball 50 is moved out of the trough of the heart and the locking is being released. Subsequently, the latching wedge 44 moves away from the door wings 3 and 4 of the folding-sliding door 2 in a direction obliquely upwardly under the effect of the force stored in the compression spring 45 and unblocks the way for the connecting element 43 and therewith for the ejection elements 5 and 6. The base element 48 and the compression spring 45 and the latching wedge 44 are held by two housing portions 47 and 49.

By way of the unlocking, the connecting element 43 and therewith the ejection elements 5 and 6 are being released. As a consequence, the linear slider 53 can move out relative to the base 54 under the release of the energy stored in the energy storage member 9 (see FIGS. 3*b* and 3*c*)). Thereby, the ejection elements 5 and 6 glide along the inclined surfaces 22 and 23 via rollers 51 and 52, respectively, whereby the extending movement of the slider 53 is being converted into a pivoting movement of the ejection elements 5 and 6. The height 69 of the inclined surfaces 22 and 23 is 20 mm. Because the ejection elements 5 and 6 are supported at the same time against the furniture carcass via the supporting elements 14 and 15, a spreading-apart movement of the folding-sliding door 2 is effected (see FIG. 3*a*)). The inclined surfaces 22 and 23 therefore serve for initiating the spreading-apart movement of the ejection elements 5 and 6.

Figure 3A:
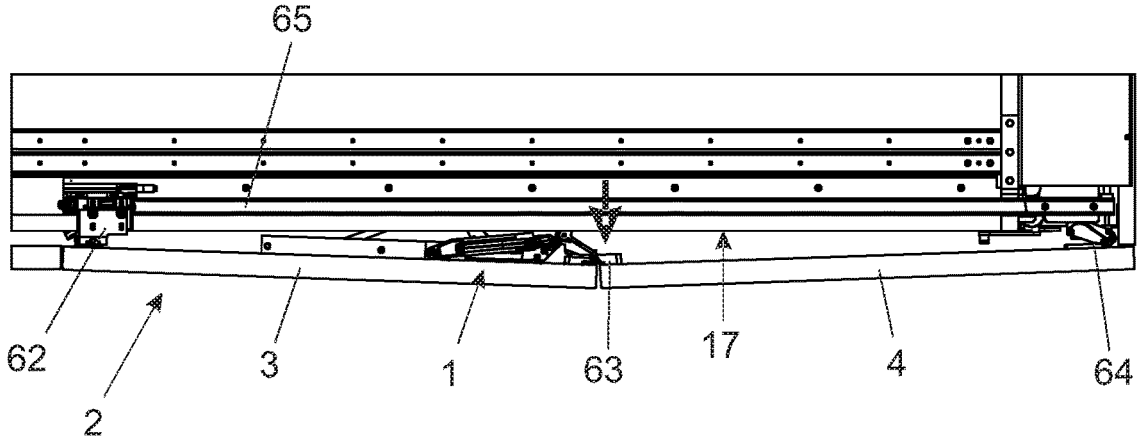

In connection with FIG. 3*a*), it is further to be noted that the door wing 4 of the folding-sliding door 2 is hingedly connected to the furniture carcass by hinges 64, the door wings 3 and 4 are connected to one another by hinges 63 and the door wing 3 is displaceably arranged by means of a running carriage 62 relative to guide elements 65 provided on the furniture carcass.

Figure 3B:
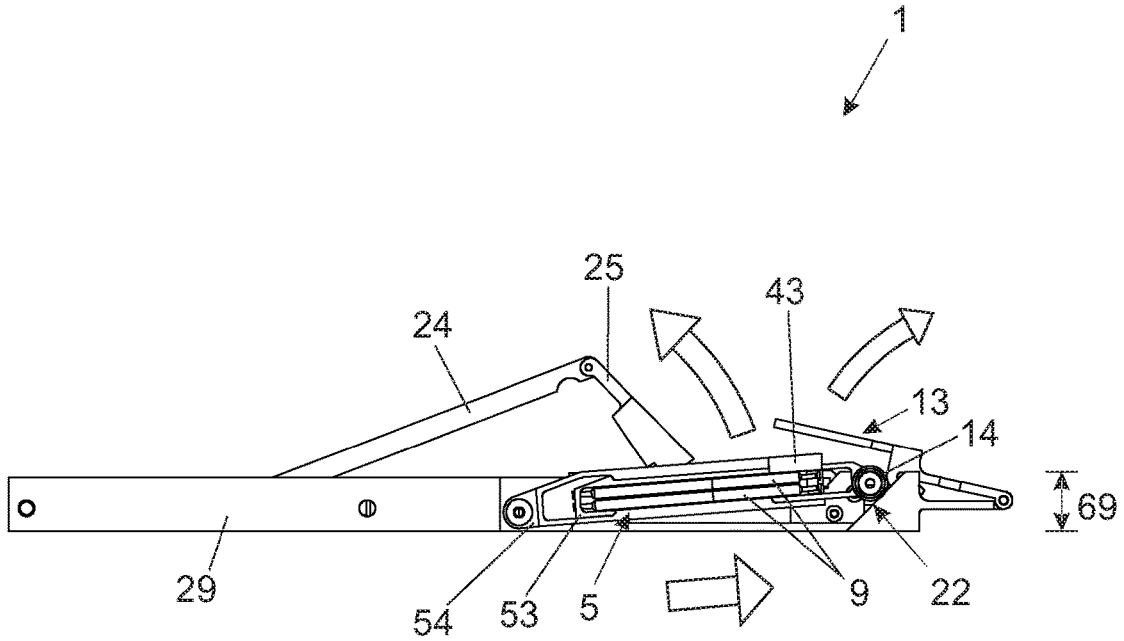
Figure 3C:
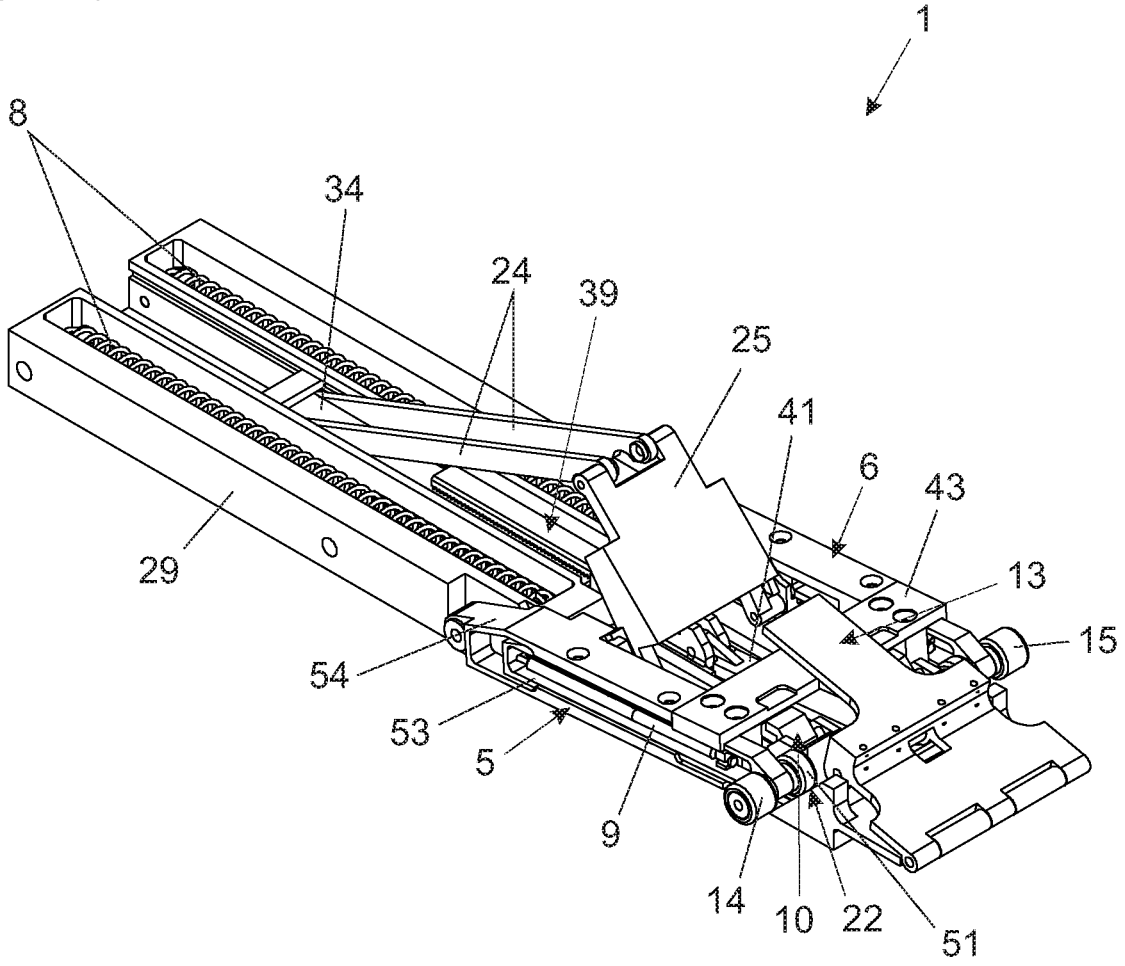

The ejection elements 5 and 6 and the pivotally-mounted loading element 13 are motionally coupled by the synchronization device 18, namely in such a way that a pivoting movement of the ejection elements 5 and 6 leads to a contrary pivoting movement of the loading element 13, and vice versa. This is indicated in FIG. 3*b*) by way of the arrows facing in the clockwise and anti-clockwise direction.

As soon as the sliders 53 are moved out at least over a region from the basis 54 and, as a result, the ejection elements 5 and 6 have been pivoted via the inclined surfaces 22 and 23, the energy stored in the force storage member 8 can become operative via the force deflection lever 24 and 25. This means that while initiating the spreading-apart movement of the ejection elements 5 and 6, initially mainly the energy stored in the force storage member 9 is being released and, subsequently, mainly the energy stored in the independent force storage member 8 is being released upon the full extension of the sliders 53 which leads to a further pivoting movement of the ejection elements 5 and 6 and therewith to a further spreading-apart movement of the folding-sliding door 2.

Figure 4A:
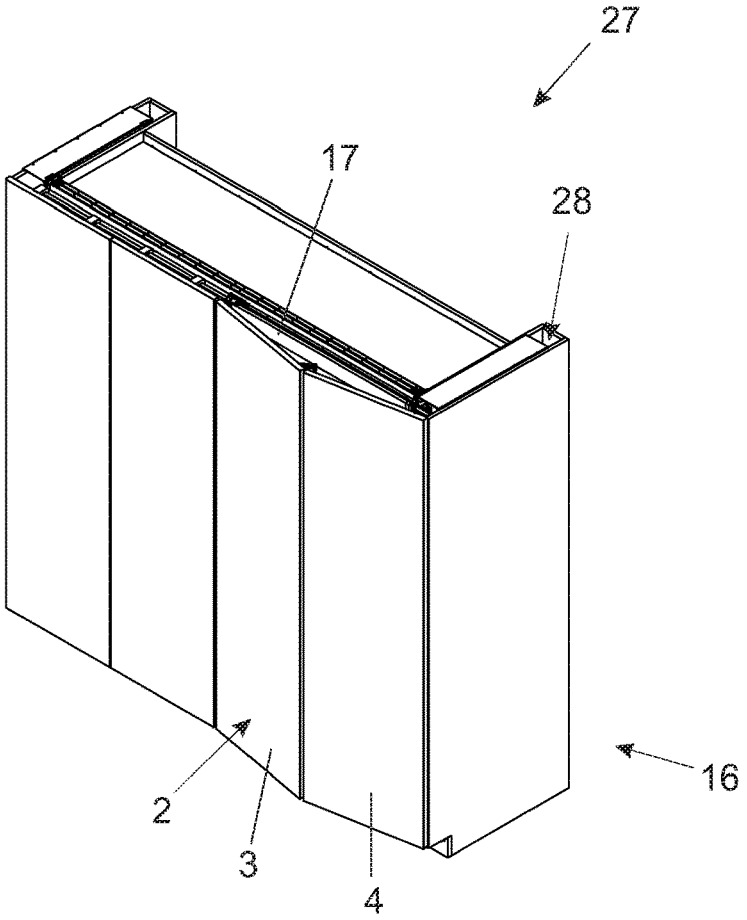
Figure 4B:
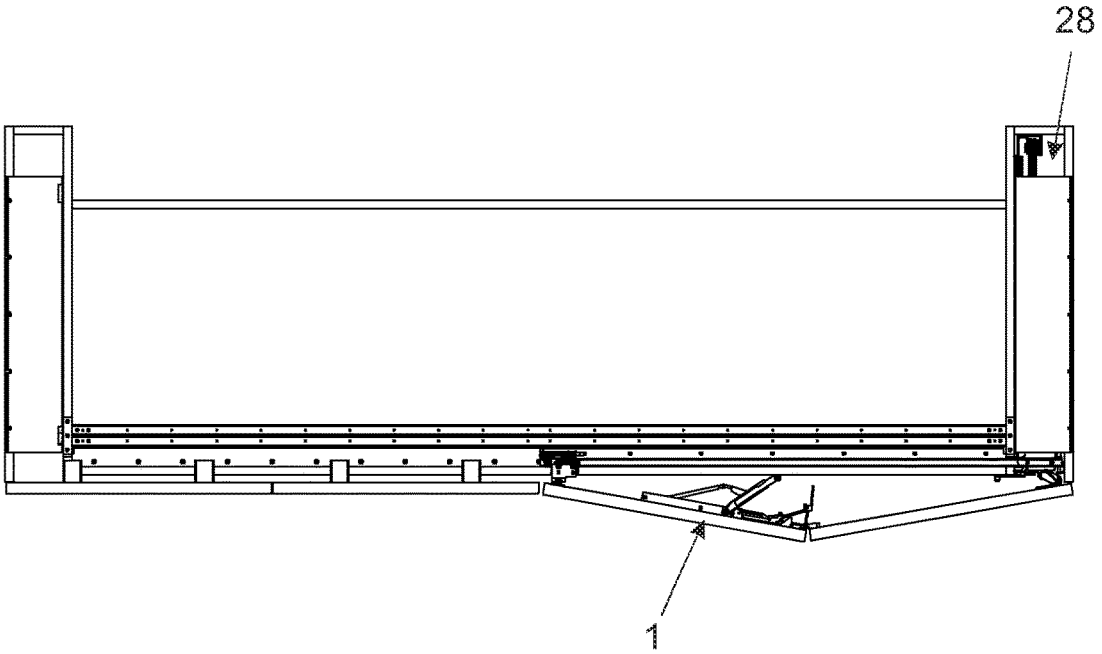

FIGS. 4*a*) and 4*b*) show an intermediate position of the folding-sliding door when being spread apart.

Figure 5A:
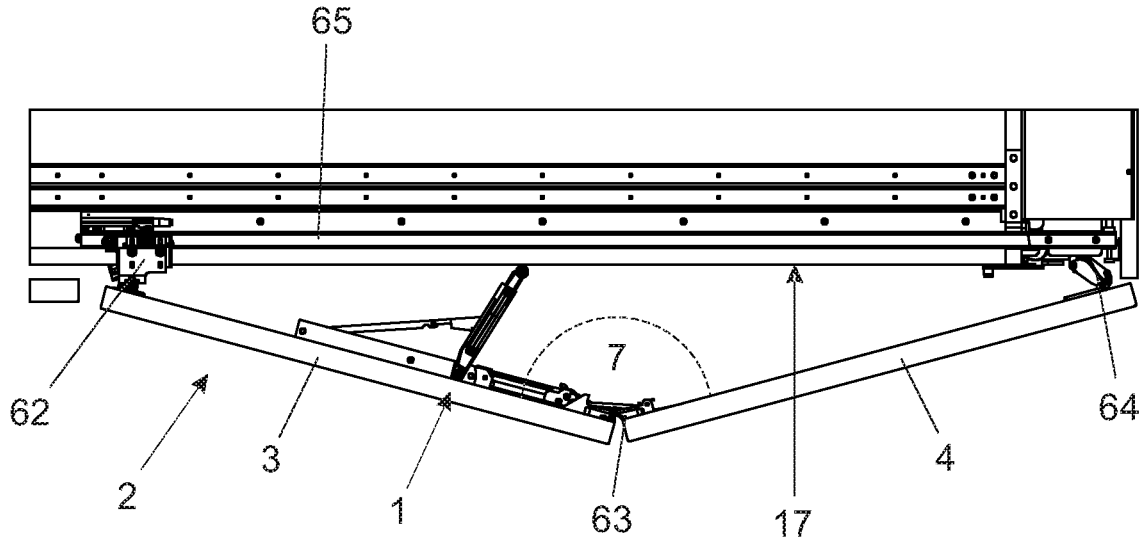
Figure 5B:
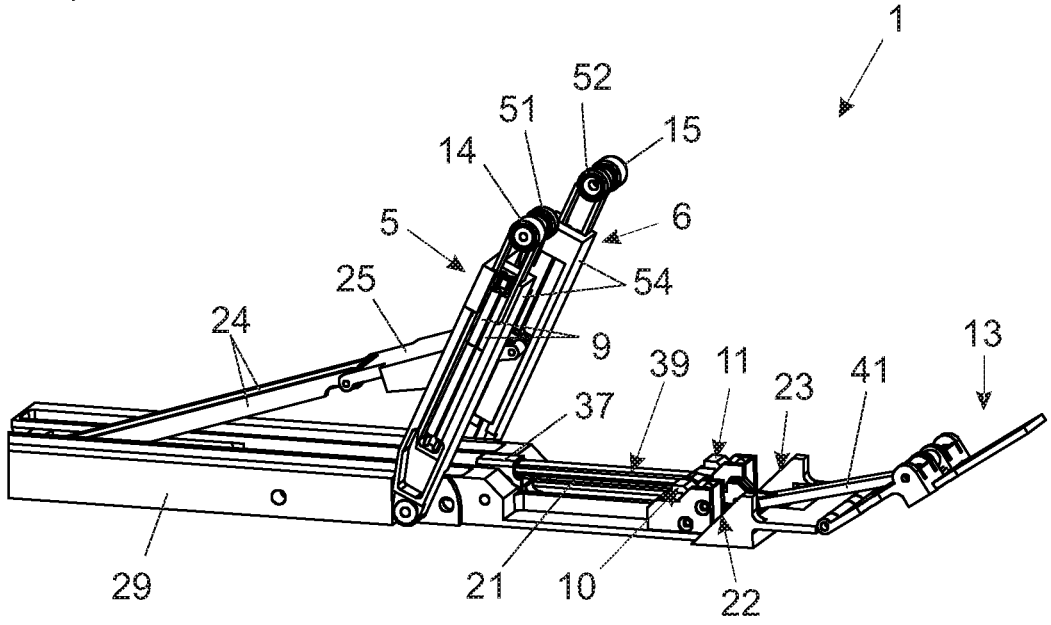

FIGS. 5*a*) and 5*b*) show the position of the folding-sliding door 2 and the ejection device 1, respectively, at the end of the spreading-apart movement of the folding-sliding door 2 starting from the closed position, in which the two door wings 3 and 4 are arranged in a common closing plane, towards an open position, in which the two door wings 3 and 4 form an angle 7 different from 180° to one another. In the specific case, the angle 7 is about 150°.

Figure 1E:
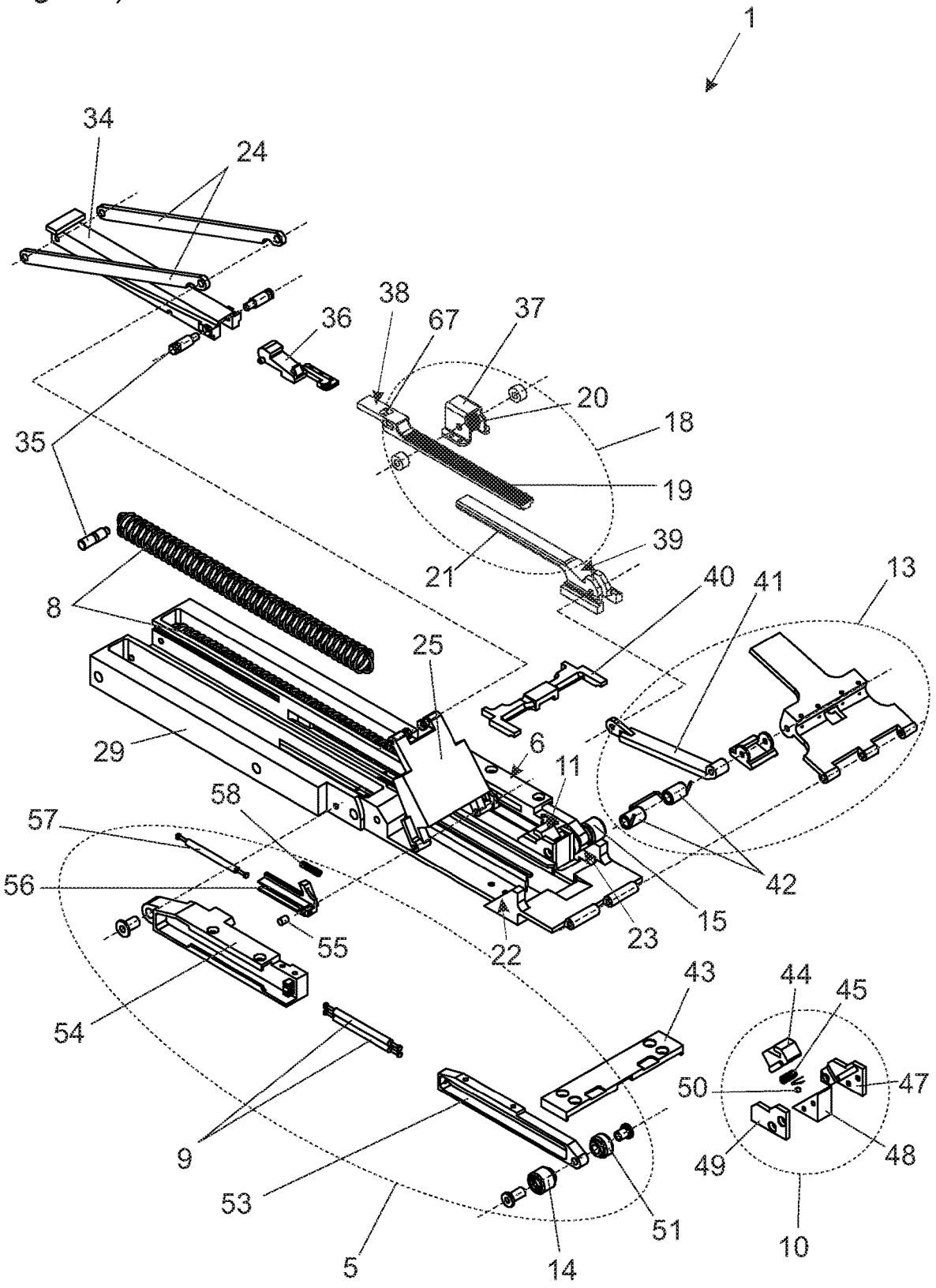

The energy storage members 8 and 9 are substantially unloaded, the sliders 53 maximally extended relative to the bases 54 and the linear slider 34 (see also FIG. 1*e*)) has reached its end position relative to the housing 29 of the ejection device 1 by virtue of the unloading of the energy storage member 8. The ejection elements 5 and 6 can therefore not further be pivoted.

At the same time, also the loading element 13 has been maximally pivoted, namely to such an extent that it comes to rest against the door wing 4. This position of the ejection device 1 therefore also marks the beginning of the loading process.

Figure 6A:
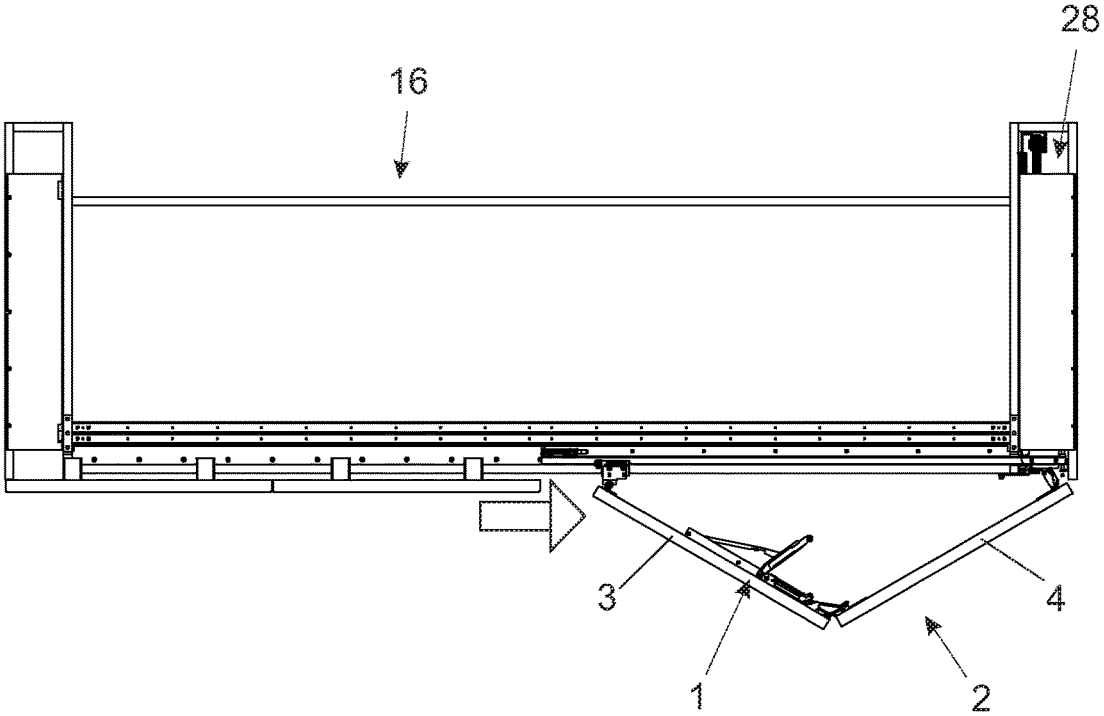

More specifically, an operator now starts to further open the folding-sliding door 2 which, at the same time, leads to a displacement of the door wing 3 and to a folding-together movement of the door wings 3 and 4, i.e. to a reduction of the angle which form the door wings 3 and 4 to one another. This force exertion by an operator is indicated with the arrow shown in FIG. 6*a*).

Figure 6B:
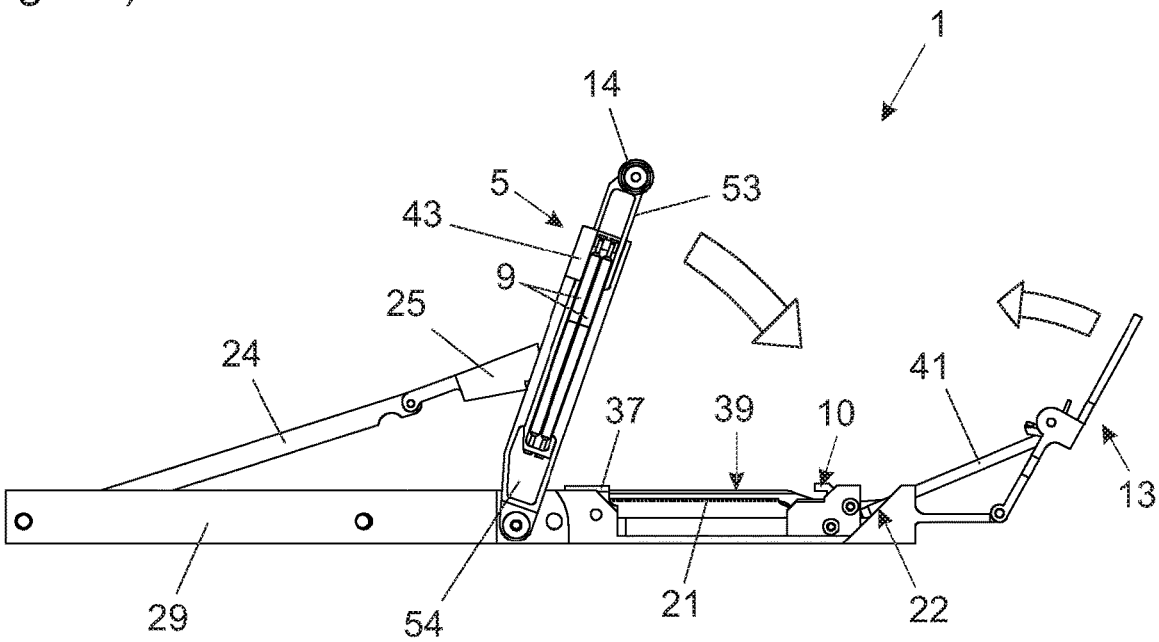
Figure 6C:
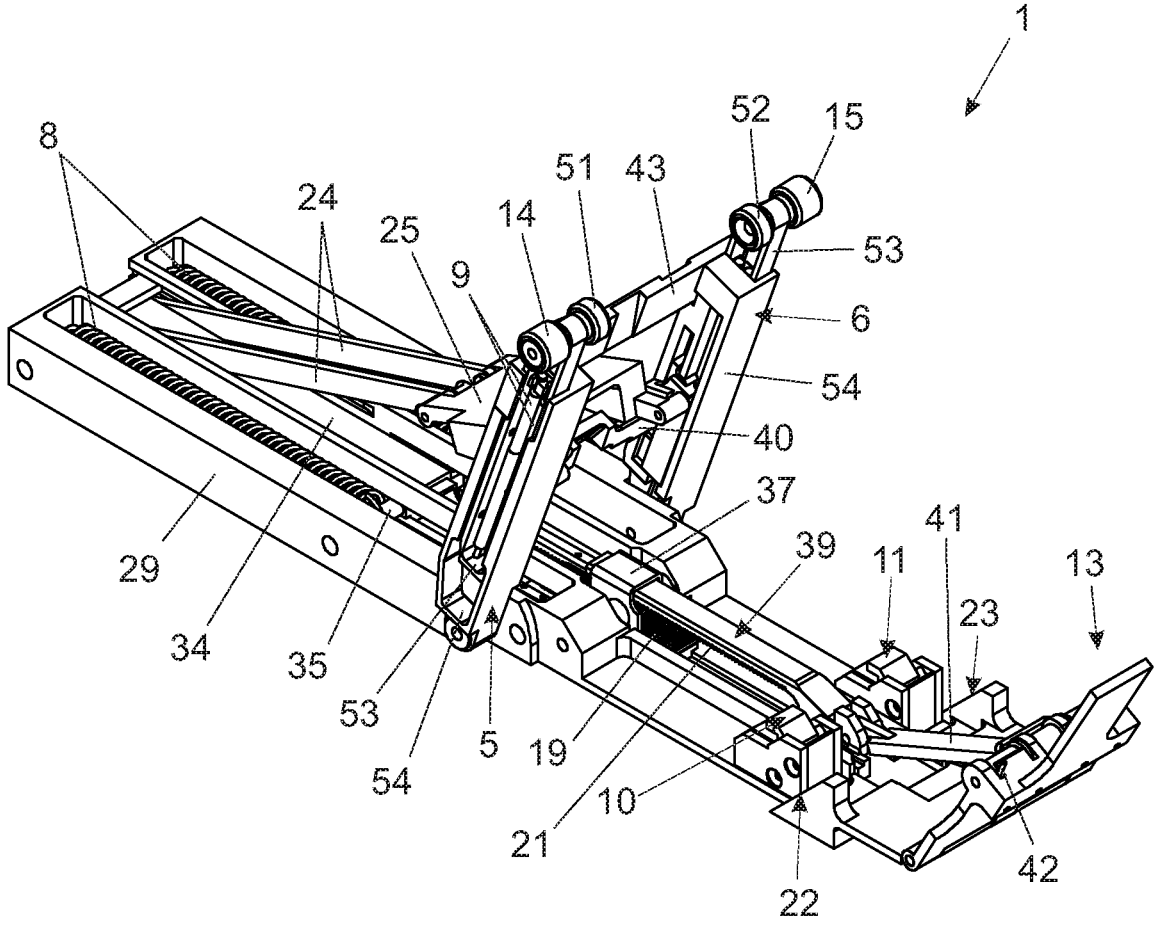

The folding together of the folding-sliding door 2 leads, due to the fact that the loading element 13 rests against the door wing 4, to a pivoting movement of the loading element 13 in a direction towards its initial position which it has been adopted in the closed position of the folding-sliding door 2 (see FIGS. 6*b*) and 6*c*)). The pivoting movement of the loading element 13 is converted via the connecting element 41 into a linear movement of the linear slider 39, and the movement of the linear slider 39 in turn results in a contrary linear movement of the linear slider 34 by way of the synchronization device 18. This leads, subsequently, to a loading of the energy storage member 8 and to a contrary pivoting movement of the ejection elements 5 and 6.

Figure 7:
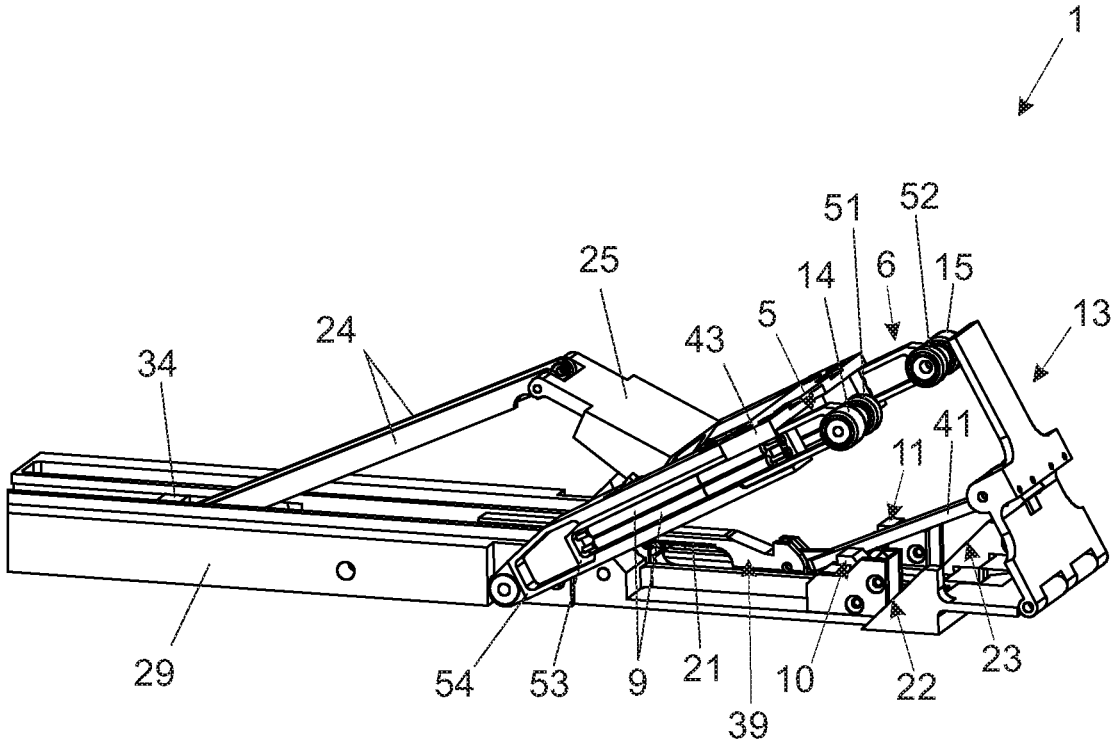

FIG. 7 shows a position of the ejection device 1 in the course of the further folding-together movement of the folding-sliding door. In this condition, only the energy storage member 8 is being loaded.

Figure 8A:
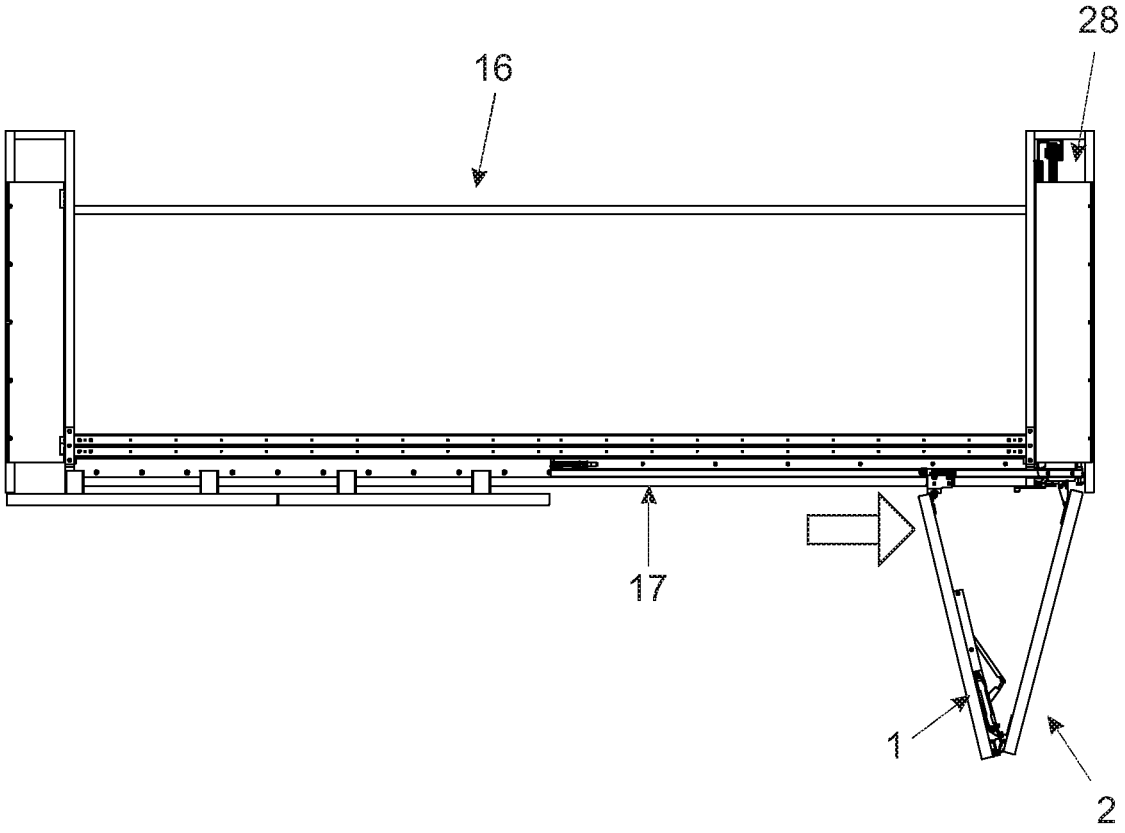

Subsequently, the ejection elements 5 and 6 engage the inclined surfaces 22 and 23 via the rollers 51 and 52, respectively, whereby the energy storage member 9 is being additionally loaded. FIGS. 8*a*) through 8*c*) exemplary show an intermediate position of the ejection device 1 when the energy storage members 8 and 9 are simultaneously loaded.

In all previously described positions of the ejection device 1, the engagement angle 26 of the force deflection lever 24, 25 is fixed to the ejection elements 5 and 6 (see FIG. 1*c*)).

Figure 8B:
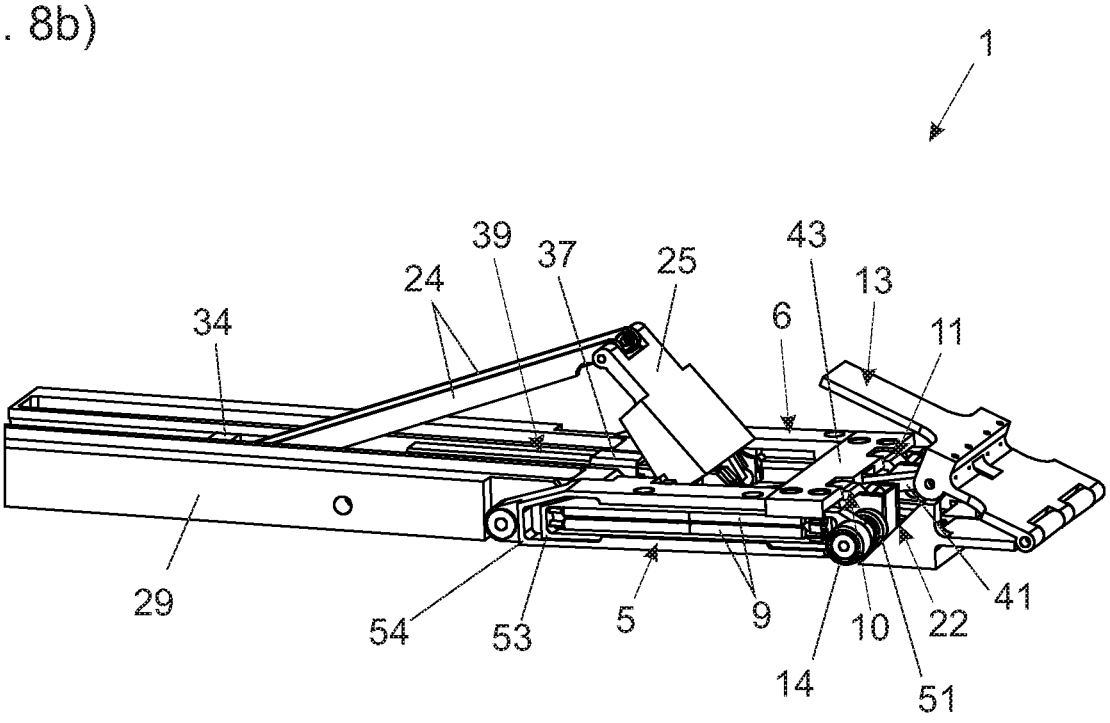
Figure 8C:
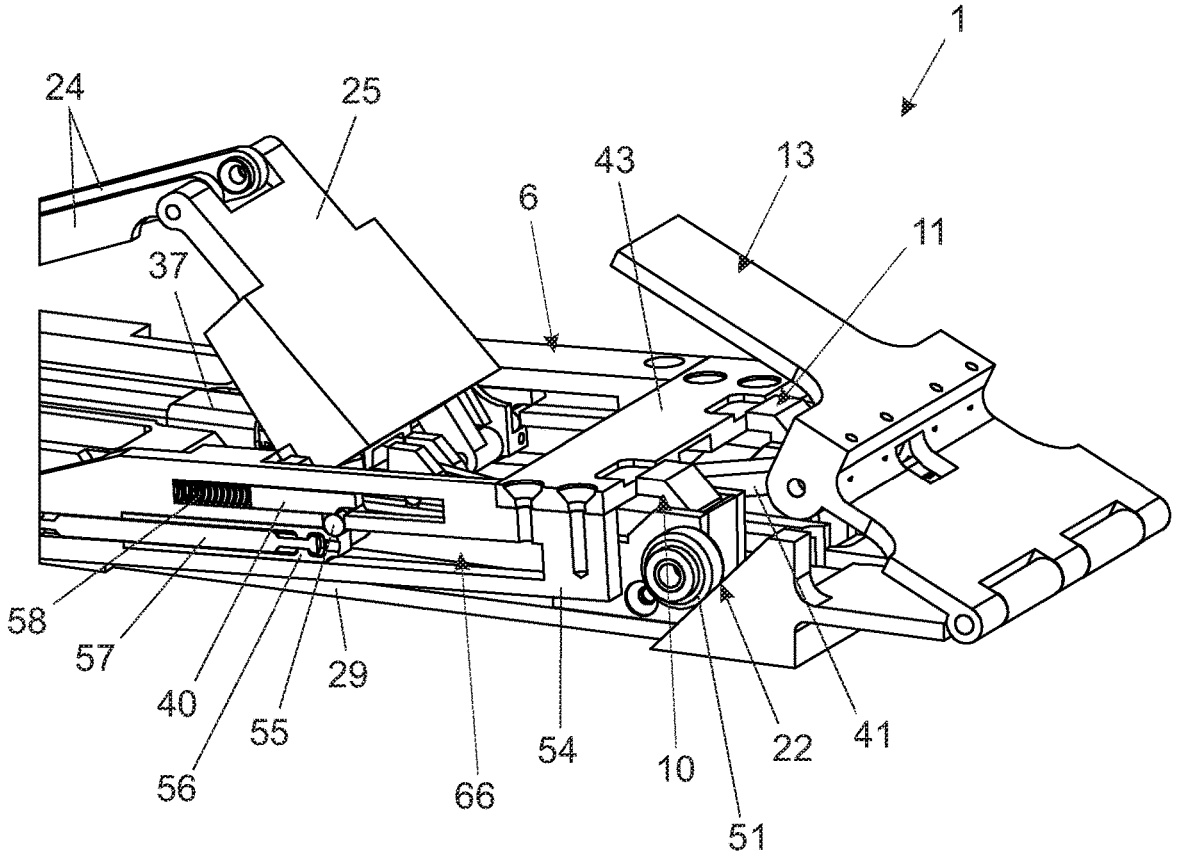

FIG. 8*c*) shows a section of the ejection device 1 of FIG. 8*b*) with the ejection element 5 cut open and serves for illustrating the fixing of the engagement angle of the force deflection lever: The force deflection lever 24, 25 is pivotally mounted to the linear slider 56 (see also FIG. 1*e*)). When the engagement angle is fixed, a pivotal movement of the plate-shaped component 25 of the force deflection lever is being prevented relative to the linear slider 56 and to the ejection elements 5 and 6, respectively. For this purpose, a catch pin 55 is provided which is arranged in an opening of the base 54 and, for fixing the engagement angle of the force deflection lever, engages into a recess provided in the linear slider 56. Thereby, a movement of the linear slider 56 in a direction of the free ends of the ejection elements 5 and 6 is being prevented. In the opposite direction, the linear slider 56 can never move, because the linear slider 56 is located in an end position of the guide track 66 provided in the base 54. The linear slider 56 is connected to the base 54 by a tension spring 57 which is slightly pre-stressed in the condition shown in FIG. 8*c*). The bolt 55, when the engagement angle is fixed, can thus not escape in a vertical direction in order for the linear slider 56 to be released, because such a movement of the bolt 55 in a vertical direction is prevented by a locking device 40 which is pressurized by a force of a compression spring 58 and which is also displaceably supported in the base 54. Overall, the linear slider 56 cannot be moved relative to the base 54. Thus, the engagement angle of the plate-shaped component 25 of the force deflection lever is fixed to the ejection elements 5 and 6.

If a person wants the folding-sliding door 2 to be fully folded together, i.e. to be moved into a position in which the door wings 3 and 4 are aligned substantially parallel to one another, the fixing of the engagement angle of the force deflection lever 24, 25 needs to be released (see FIG. 9*a*)). Release of the fixing is effected in such a way that the loading element 13 is being moved further in a direction towards the base 29 of the ejection device 1 by a relative movement of the door wings 3 and 4 of the folding-sliding door 2. In this way, the locking device 40 arranged on the linear slider 39, which is coupled to the loading element 13 via the connecting element 41, is being moved away from the plate-shaped component 25 of the force deflection lever (see FIG. 1*e*)). This means that the locking device 40 is being moved in the base 54 of the ejection elements 5 and 6 in such a way that the compression spring 58 is even further compressed. As visible in FIG. 9*b*), the bolt 55 is thereby being released in the vertical direction. When now pressure is being applied to the force deflection lever 24, 25 by a relative movement of the door wings 3 and 4 of the folding-sliding door 2, this leads to an application of force of the linear slider 56 pushing away the bolt 55 in the vertical direction. The linear slider 56 can be moved in the guide track 66 provided in the base 54 in a direction of the free ends of the ejection elements 5 and 6 and therewith the force deflection lever 24, 25 can be folded together.

Figure 9A:
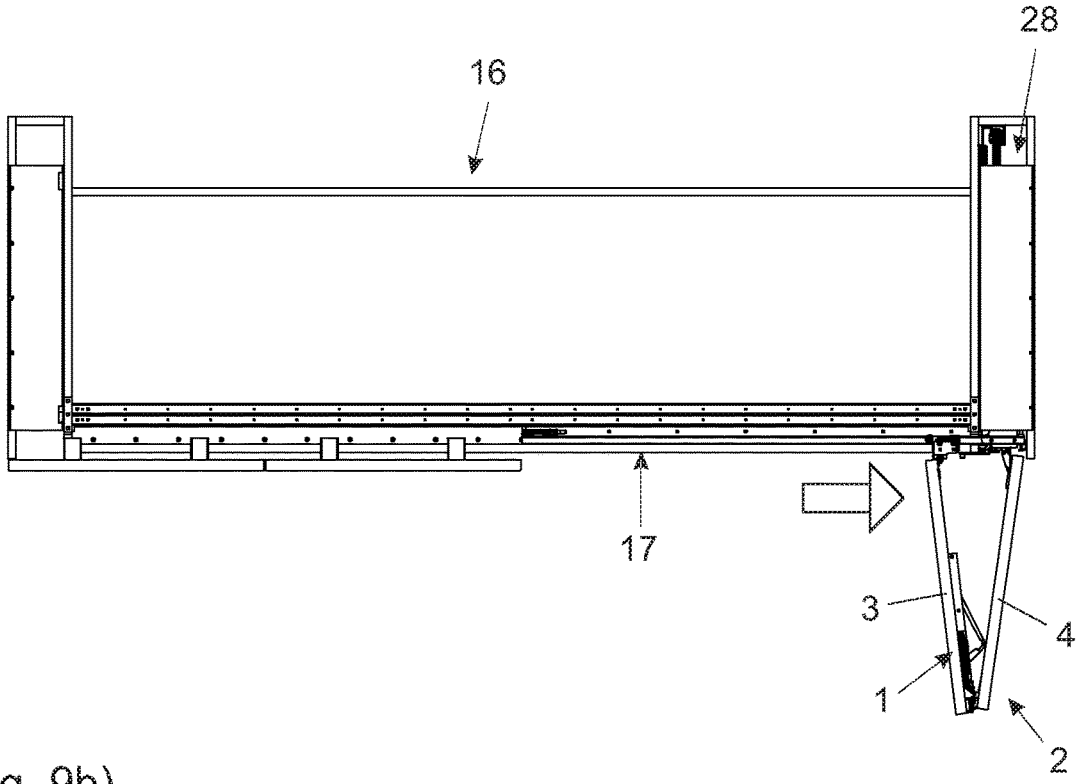
Figure 9B:
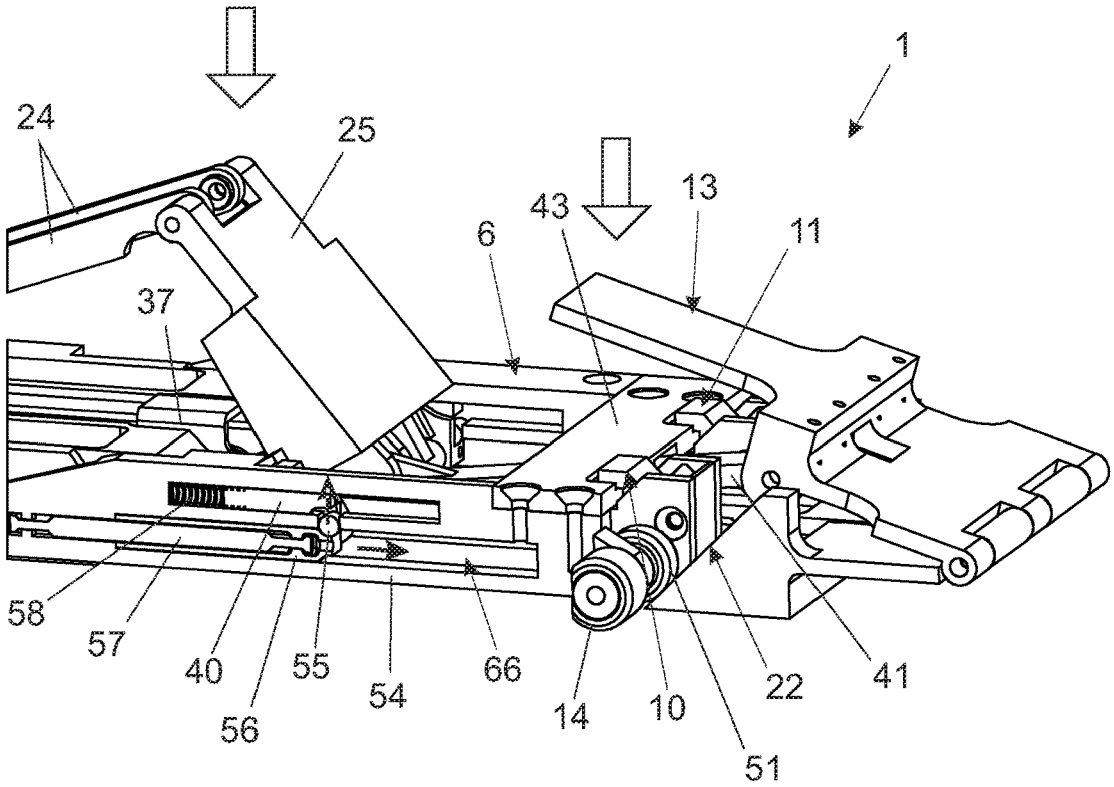
Figure 9C:
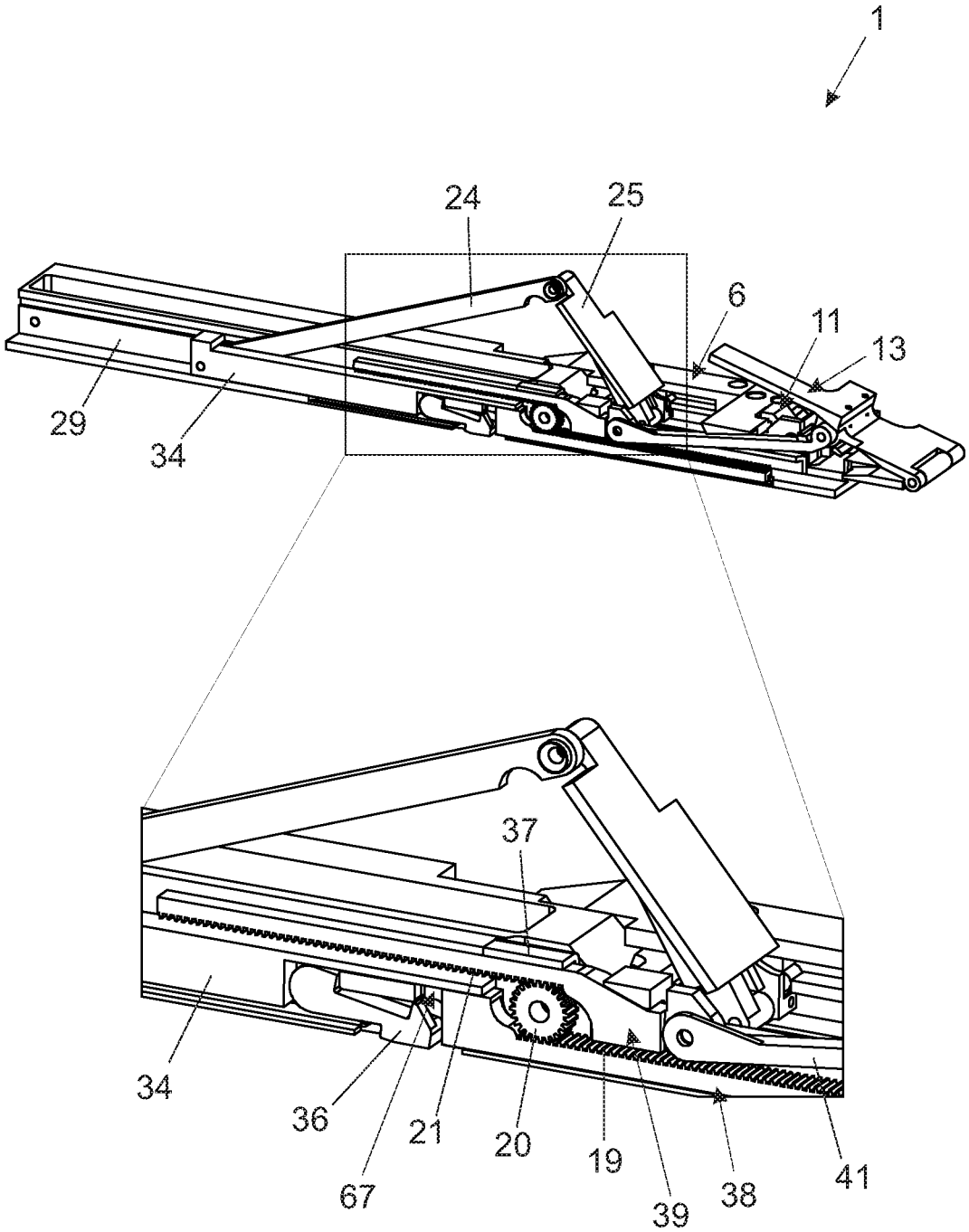

It is further to be noted that when the ejection device 1 reaches the position shown in FIGS. 9*a*) through 9*c*), the loading operation of the energy storage members 8 and 9 is completed. In order to avoid an undesired unloading in this condition, the ejection elements 5 and 6 are being locked by means of the locking devices 10 and 11.

Because also the energy storage member 8 is loaded, the loading element 13, however, needs to be tilted onto the base 29, just like the force deflection lever 24, 25, in order for the parallel position of the door wings 3 and 4 to be obtained (see FIG. 10*a*) through 10*c*)) and because of the fact that the loading element 13 is motionally coupled to the linear slider 38 via the linear slider 39 by means of the synchronization device 18, it is useful to conserve the loading condition of the energy storage member 8 and to enable a substantially effortless folding together of the force deflection lever 24, 25 and of the loading element 13. This is made possible because the coupling of the linear sliders 34 and 38 via the locking pawl 36, which is pivotally mounted to the linear slider 34 and which engages in an opening 67 of the linear slider 38 in the coupled state, is being released by a movement of the locking pawl 36 in a direction away from the linear slider 38. Thereby, the linear slider 34 is fixed to the base 29 with a loaded energy storage member 8 (see FIG. 9*c*)). By decoupling the linear sliders 34 and 38, the linear slider 38 can therewith be moved in a powerless manner upon a movement of the linear slider 39 which is coupled to the loading element 13.

Figure 10A:
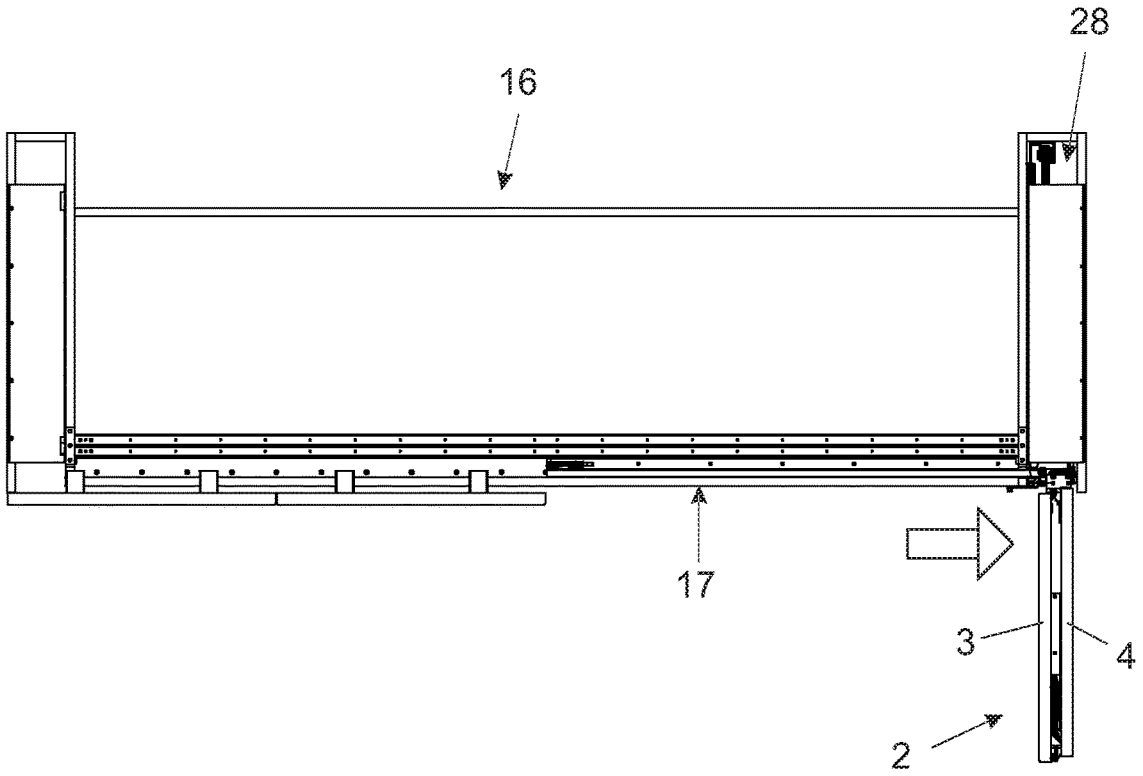
Figure 10B:
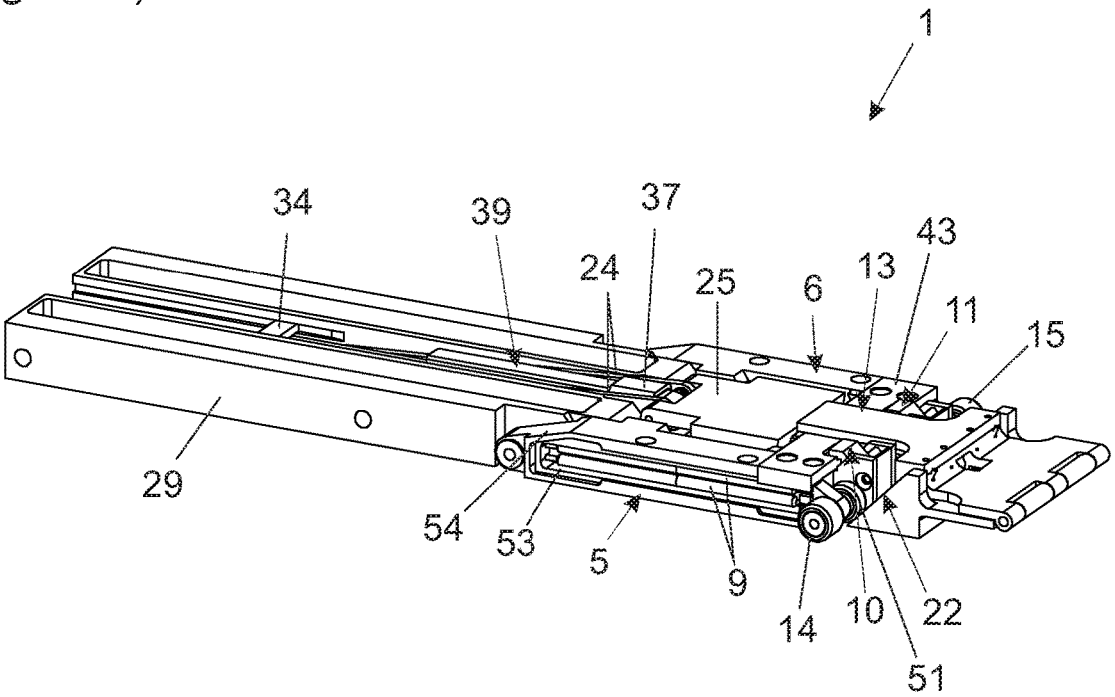
Figure 10C:
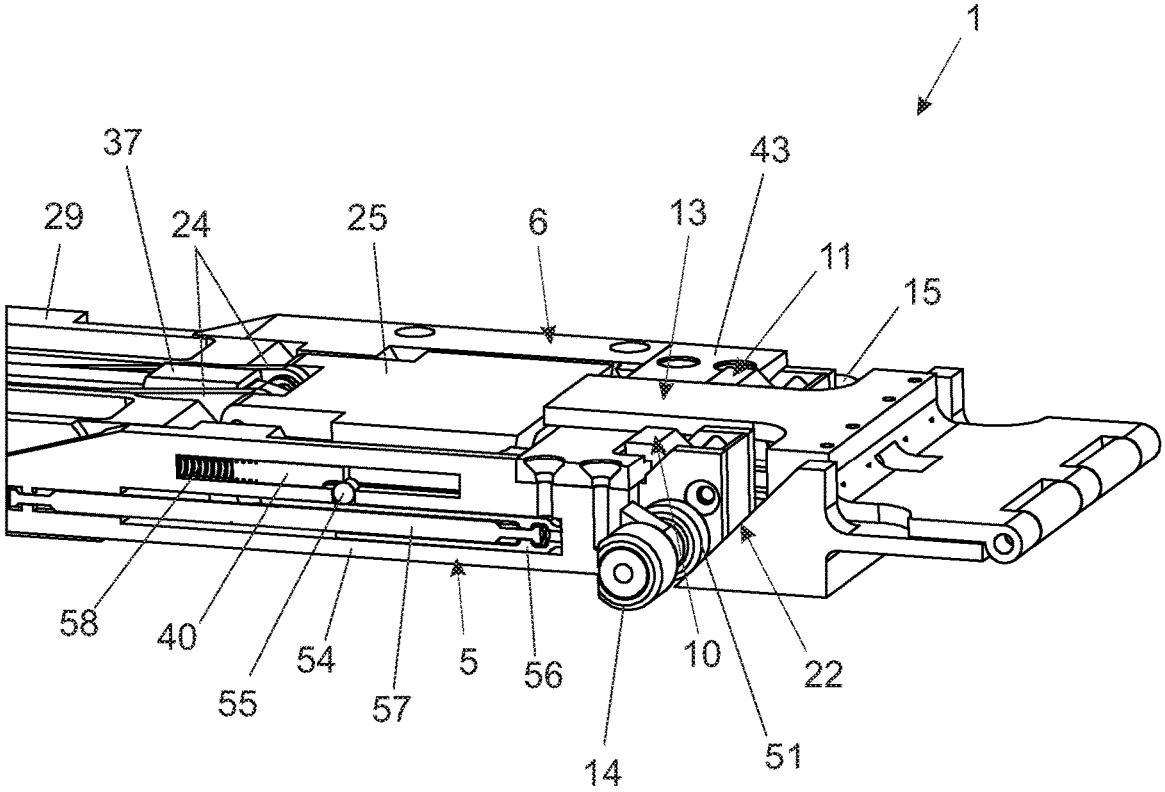

FIG. 10*a*) shows the folding-sliding door 2 in a condition when fully folded together, in which the two door wings 3 and 4 are aligned substantially parallel to one another. FIGS. 10*b*) and 10*c*) show the condition which assumes the ejection device 1 in this position of the folding sliding door 2. More specifically, all elements of the ejection device 1 in this condition are arranged in the plane of the base 29. FIG. 10*c*) shows a section of the ejection device 1 with the ejection element 5 cut open. The linear slider 56 is located in the guide track 66 (see FIG. 8*c*) for example) in the end positions adjacent to the free ends of the ejection elements 5 and 6. The tension spring 57 is fully loaded.

Figure 11A:
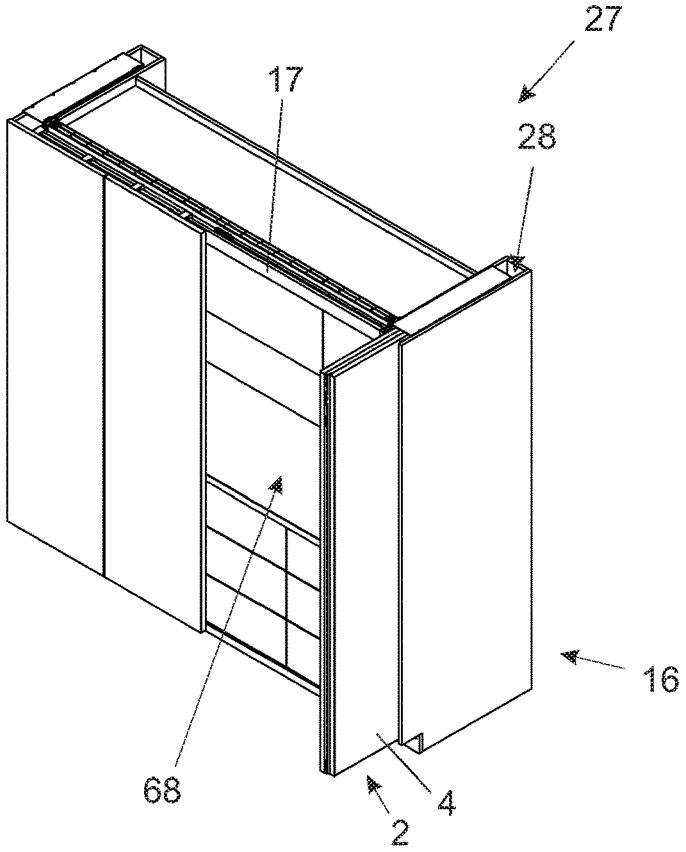
Figure 11B:
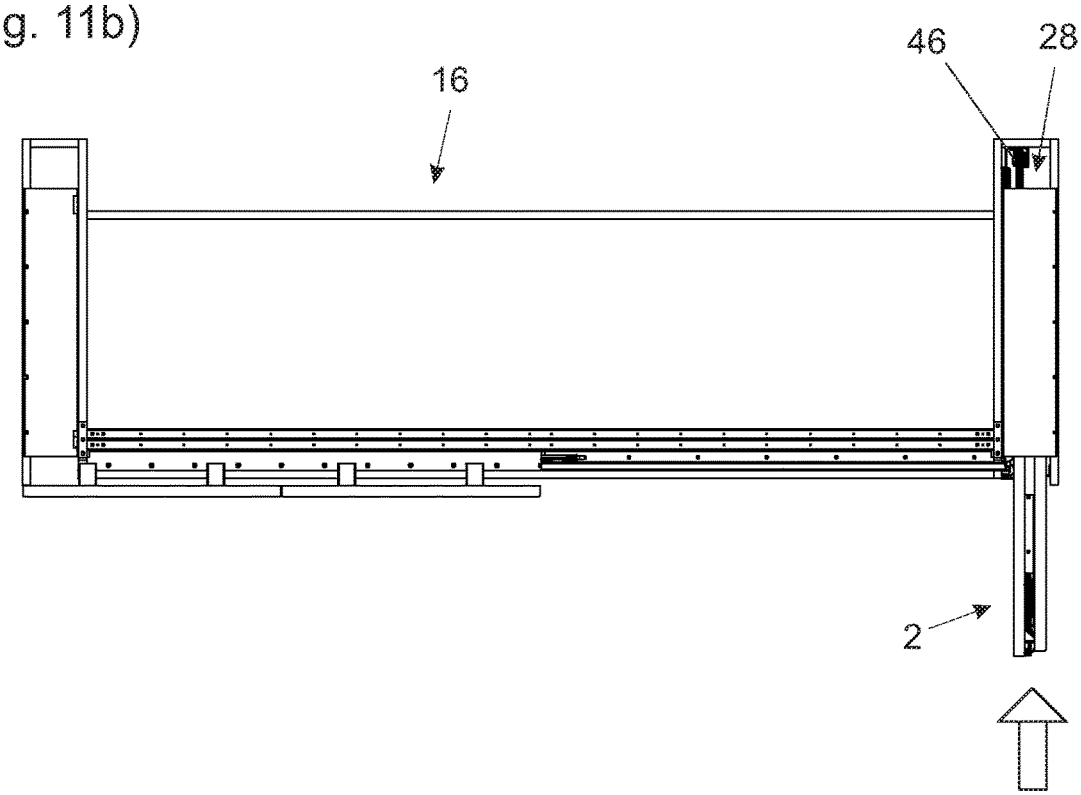
Figure 12A:
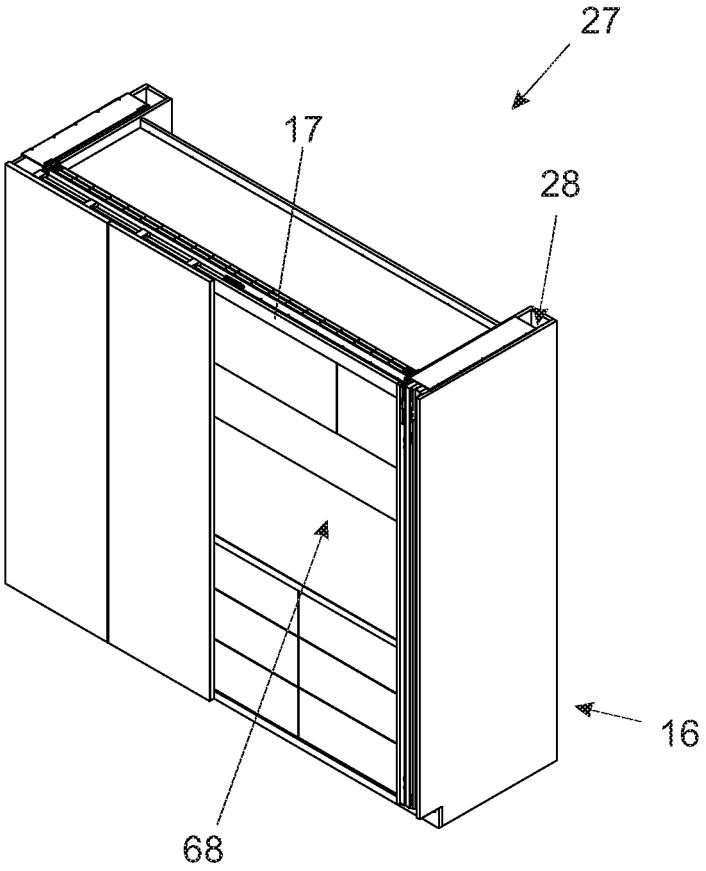
Figure 12B:
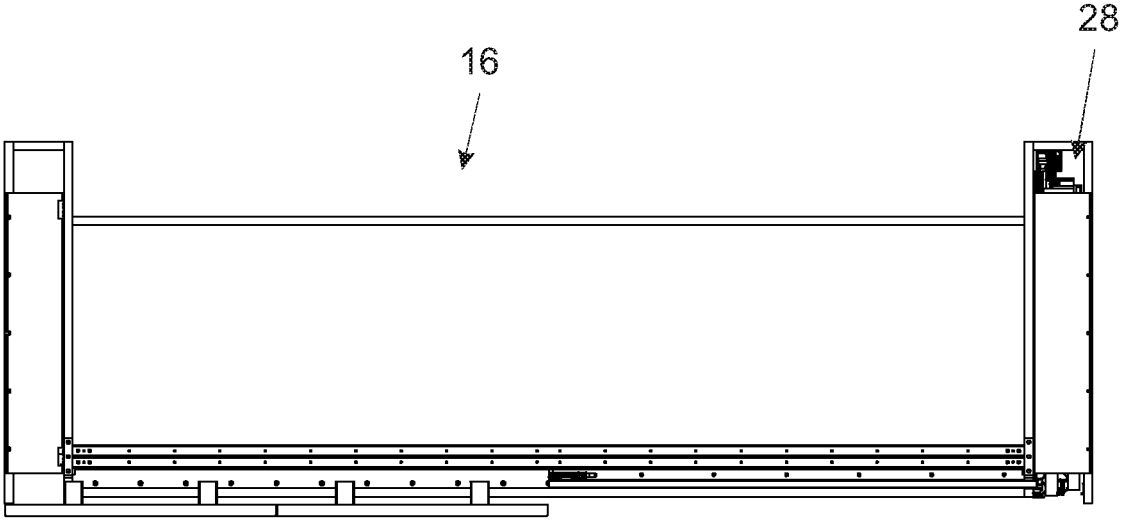

As shown in FIGS. 11*a*) and 11*b*) as well as in FIGS. 12*a*) and 12*b*), the folded together folding-sliding door 2 can now be accommodated within a cavity 28 arranged in or on the furniture carcass 16, respectively. For this purpose, a guide device 46 for the folding-sliding door 2 is arranged in or on the cavity 28. Now, the interior of the item of furniture 27 is freely accessible. Within the interior, a kitchen 68, for example, can be provided.

Figure 13A:
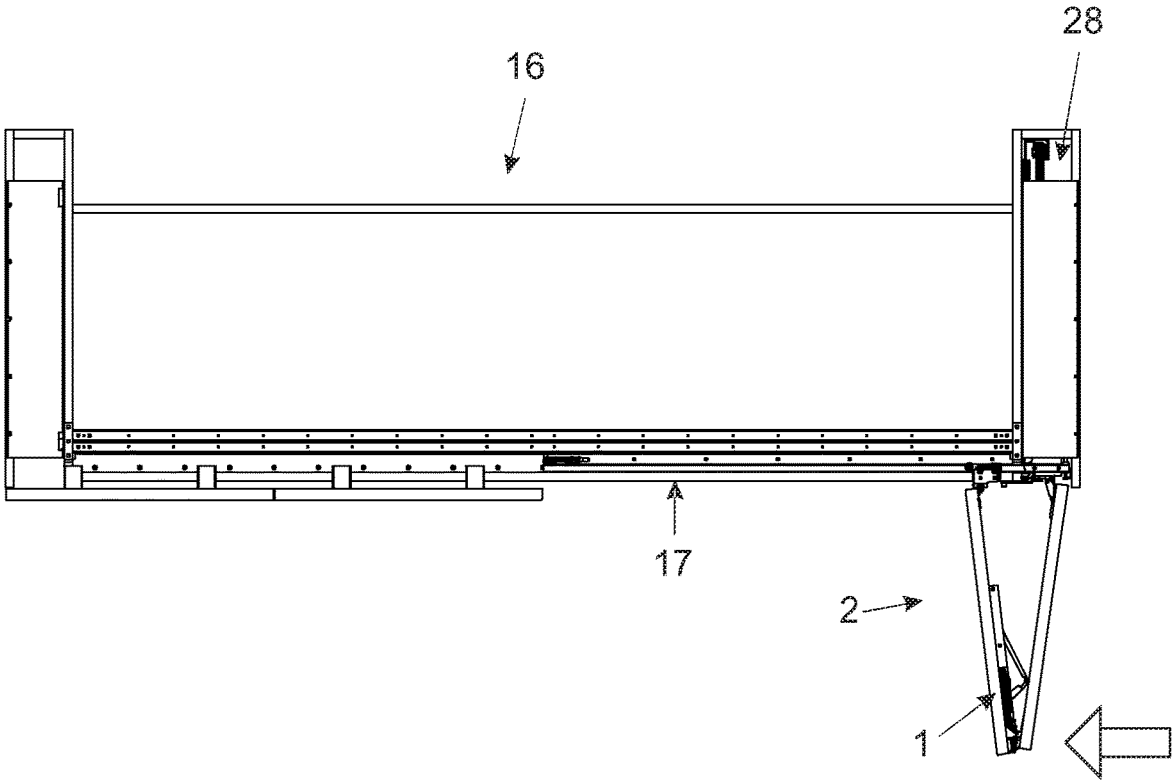
Figure 13B:
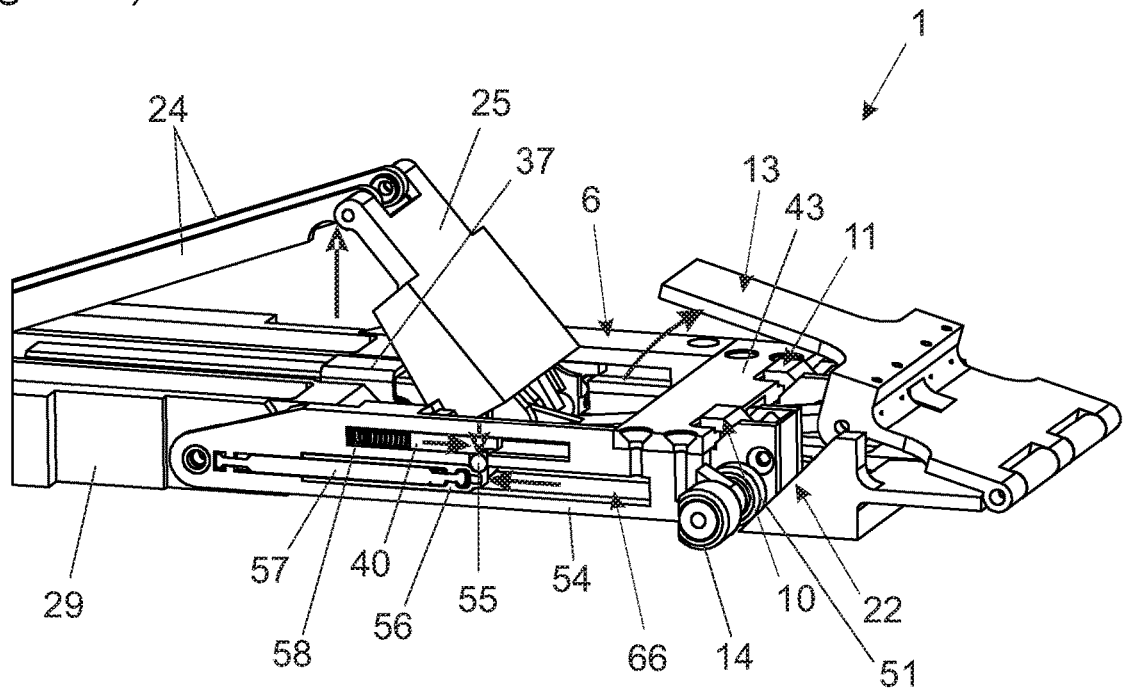

In order to transfer the folding-sliding door 2 starting from the condition shown in FIGS. 12*a*) and 12*b*) again into the closed position shown in FIG. 1*a*), the folded together folding-sliding door 2 is again being moved out of the cavity 28. Upon spreading apart the folding-sliding door 2, the force deflection lever 24 and 25 spreads apart under the release of the energy stored in the tension spring 57. Also, the loading element 13 pivots again away from the base 29. For this purpose, two leg springs 42 are provided (see FIG. 1*e*)) which hold the loading element 13 in the neutral position, as shown in FIG. 1*d*) for example. When the folding-sliding door 2 is fully folded together, energy is being stored in the leg springs 42, the energy is again being released when spreading apart the folding-sliding door 2. The linear slider 56 is again being locked and the engagement angle of the force deflection lever 24, 25 to the ejection elements 5 and 5 is therewith fixed (see FIG. 13*b*)).

Figure 13C:
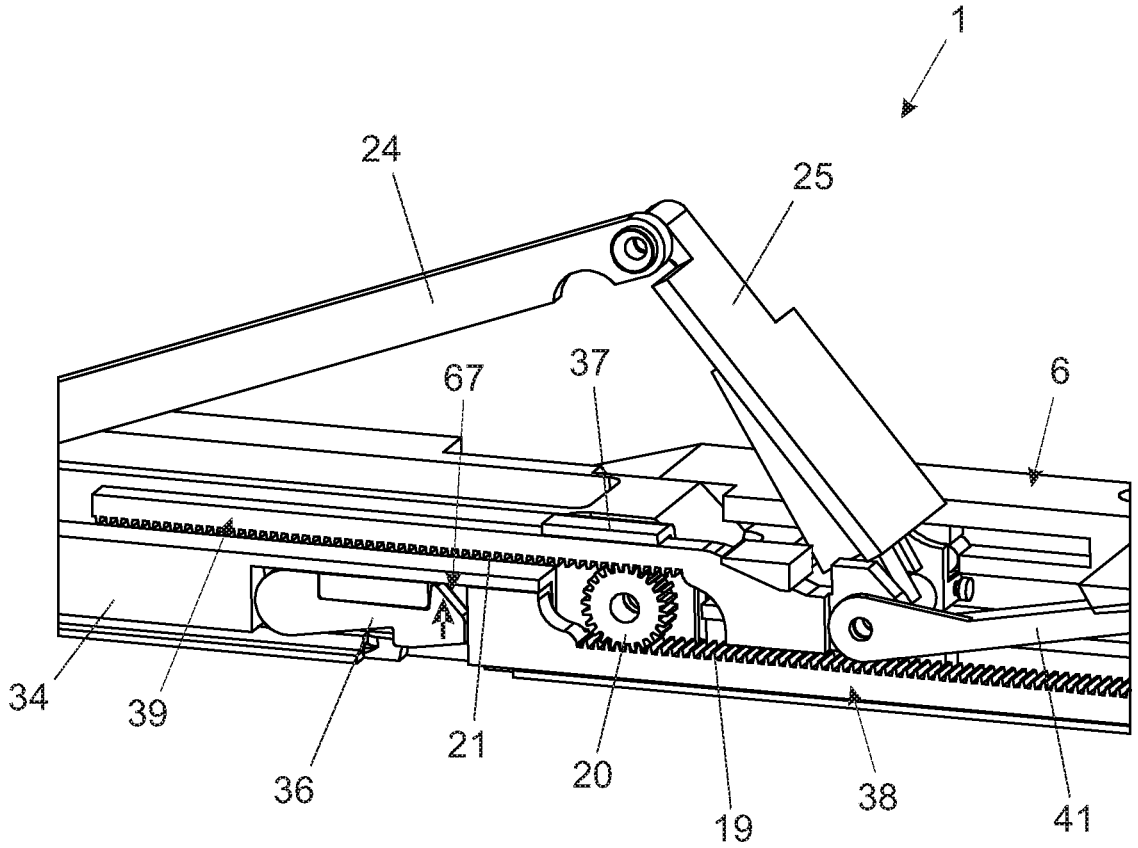

Further, the two linear sliders 34 and 38 are again being connected to one another by way of the locking pawl 36 (see FIG. 13*c*)). Overall, the ejection device 1 is again located in its initial position (see FIGS. 1*c*) and 1*d*)) and remains there until the next release.

Figure 14:
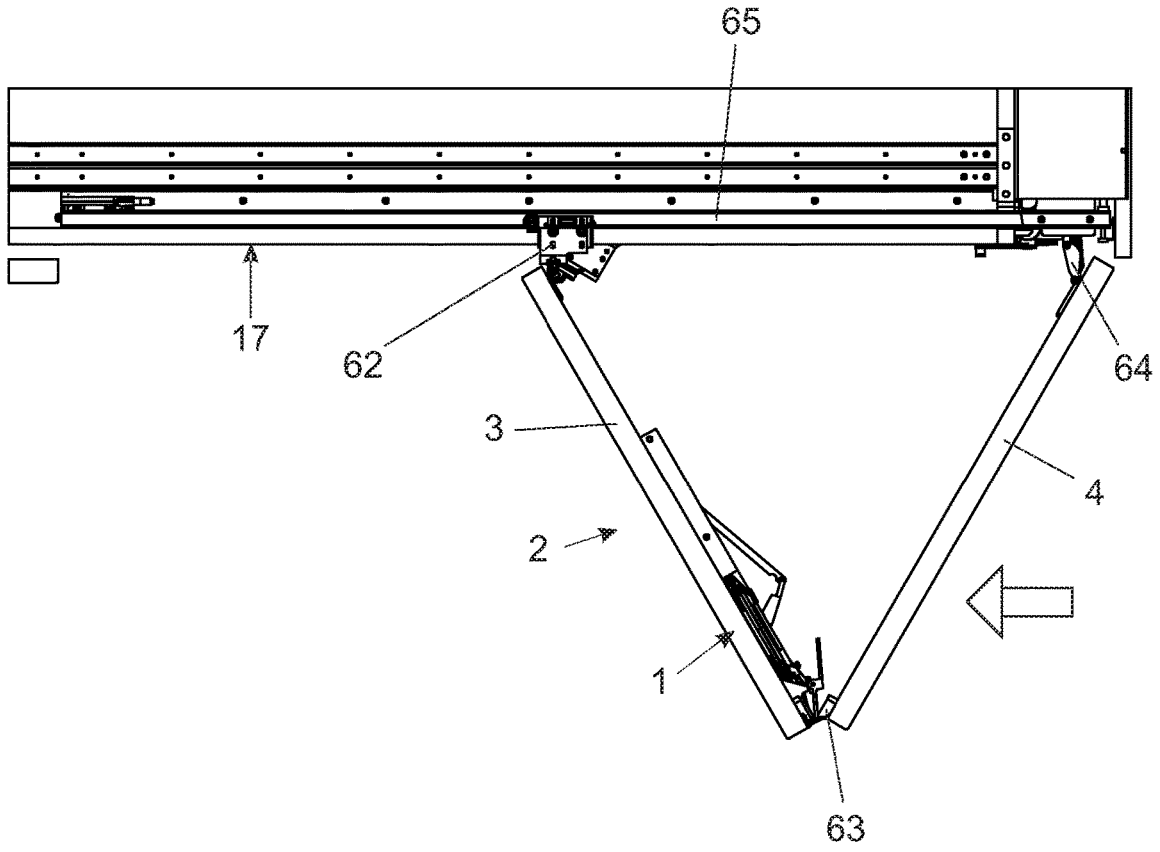

FIG. 14) shows an intermediate position of the folding-sliding door 2 upon a transfer of the folding-sliding door 2 from the condition shown in FIGS. 12*a*) and 12*b*) into the closed condition shown in FIG. 1*a*) upon applying pressure by an operator.

The invention claimed is:

1. An ejection device for a folding door having at least two door wings hingedly connected to one another, the ejection device including:

at least one ejection element for spreading apart the folding door from a closed position, in which the at least two door wings are arranged in a common closing plane, towards an open position, in which the at least two door wings form an angle different from 180° relative to each other;

at least one energy storage member for acting upon the at least one ejection element;

at least one locking device for releasably locking the at least one ejection element against a force of the at least one energy storage member, the at least one locking device being configured to be unlocked by applying pressure to the folding door; and at least one movably-mounted loading element for loading the at least one energy storage member by folding together the folding door, wherein:

the at least one ejection element is configured as a pivotally mounted ejection lever; and the at least one ejection element and the at least one movably-mounted loading element are motionally coupled by a synchronization device.

2. The ejection device according to claim 1, wherein the at least one movably-mounted loading element is configured as a pivotally mounted loading lever.

3. The ejection device according to claim 1, wherein the synchronization device includes a tooth arrangement.

4. The ejection device according to claim 1, wherein the at least one ejection element and the at least one movably-mounted loading element are pivotally mounted, and the synchronization device is configured such that the at least one ejection element and the at least one movably-mounted loading element are pivotable in opposite directions.

5. The ejection device according to claim 1, wherein the ejection device is mirror-symmetrical.

6. The ejection device according to claim 1, further including a base with at least one inclined surface for pivoting the at least one ejection element.

7. The ejection device according to claim 1, wherein the at least one energy storage member includes at least two independent energy storage members for acting upon the at least one ejection element.

8. The ejection device according to claim 1, wherein the at least one locking device is configured to be unlocked by applying the pressure to the folding door in a region where the at least two door wings are hingedly connected to one another.

9. The ejection device according to claim 1, wherein the at least one ejection element includes at least one supporting element.

10. The ejection device according to claim 9, wherein the at least one supporting element is a roller.

11. The ejection device according to claim 1, further including a force deflection lever between the at least one energy storage member and the at least one ejection element.

12. The ejection device according to claim 11, wherein the at least one ejection element is configured to releasably fix an engagement angle of the force deflection lever.

13. An item of furniture, including:

a furniture carcass;

at least one folding door having at least two door wings hingedly connected to one another, the at least one folding door being configured to assume: (i) a closed position, in which the at least two door wings are arranged in a common closing plane; and (ii) an open position, in which the at least two door wings form an angle different from 180° relative to each other; and at least one ejection device according to claim 1.

14. The item of furniture according to claim 13, wherein the furniture carcass includes a cavity for accommodating the at least one folding door in the open position.

15. The item of furniture according to claim 13, wherein the at least one ejection device is arranged on a side of a first of the at least two door wings facing towards the furniture carcass.

16. The item of furniture according to claim 15, wherein the at least one movably-mounted loading element is configured to interact with a second of the at least two door wings upon folding together the at least one folding door.

* * * * *